United States Patent [19]

Yamada

[11] 4,285,625

[45] Aug. 25, 1981

[54] METHOD AND APPARATUS FOR CUTTING AND PEELING THE PACKAGING MATERIAL OF AN ELONGATED PACKAGE CONTAINING A PRODUCT

[75] Inventor: Morio Yamada, Yokohama, Japan

[73] Assignee: Toyo Seikan Kaisha, Ltd., Tokyo, Japan

[21] Appl. No.: 967,924

[22] Filed: Dec. 8, 1978

[30] Foreign Application Priority Data

Dec. 17, 1977 [JP] Japan ..... 52-151220

[51] Int. Cl.[3] ..... B65B 65/09; B65B 17/00

[52] U.S. Cl. ..... 414/412; 198/472; 53/381 R

[58] Field of Search ..... 406/88; 414/412; 198/347, 472; 83/857, 425, 175, 277; 53/381 R

[56] References Cited

U.S. PATENT DOCUMENTS

| | | | |
|---|---|---|---|
| 3,812,947 | 5/1974 | Nygaard | 406/88 |
| 4,014,428 | 3/1977 | Ossbahr | 198/472 |
| 4,085,759 | 4/1978 | Seragnoli | 198/347 |
| 4,158,417 | 6/1979 | Inoue | 414/412 |

*Primary Examiner*—Leslie J. Paperner
*Assistant Examiner*—L. E. Williams
*Attorney, Agent, or Firm*—Jordan and Hamburg

[57] ABSTRACT

A method and apparatus for cutting and peeling the packaging material of an elongated package containing a product comprise gripping the packaging material of the package at the upper portion and all over the length thereof after said package is fed from a feeding section to a certain position in a cutting section, thrusting the cutting blades of a cutter member into the packaging material to cut a continuous cut line between the gripped upper side thereof and the product, forcedly peeling off the packaging material of the package fed to a certain position in a peeling section, discharging the exposed product into a delaying and storing section where the product is shifted stepwise and successively to be delayed and stored therein, and delivering the product to a discharging section where the product is received and discharged successively and intermittently.

11 Claims, 25 Drawing Figures

90
109
103
101
97
99
89c
93
95
51b
67a
51a
142
126
130
186
128
125
141
120
119
12
13
197
196
199
198
J
161
165
159
165a
171
174
189
XIII
170
175
160
164a
164
178
180
159a
177
9
181
118
117
139
140
124
123
179
127
129
151
152
52b
52a
148
147
91a
α
4
91
Z
90
51a
89a
107
106
105
89d
104
89
88

METHOD AND APPARATUS FOR CUTTING AND PEELING THE PACKAGING MATERIAL OF AN ELONGATED PACKAGE CONTAINING A PRODUCT

The present invention relates to a method of and apparatus for automatically cutting the packaging material of an elongated package containing a product which consists of a plurality of can ends, bottle caps or the like, and peeling the packaging material off said elongated package to bring out said product, said packaging material being kraft paper, resin-coated paper or the like and said can ends or bottle caps being of same shape and piled one another to form said elongated package.

As the automatically cutting and peeling method of aforesaid type, there has been employed the method of pressing a cutter of knife-shape onto the elongated package to form a cut line at the upper portion and along the longitudinal axis of said package, or gripping the packaging material of said package by a pair of eccentric rolls and cutting the packaging material below the gripped portion thereof by a rotating cutter of circular saw-shape.

However, in the case of using the knife-shaped cutter there is the fear of damaging the product such as can ends and bottle caps packaged in the packaging material. In addition, the life of the cutter is so short that it must be often exchanged with a new one, thus lowering the working efficiency of said apparatus to give bad effect on the other whole processing lines connected to said apparatus.

On the other hand, in the case of employing the circular saw-shaped cutter, the packaging material below the gripped portion thereof avoids said cutter due to the collapsing phenomenon of said material at the time when the tip of said cutter is thrust into said material, so that the cutting operation by said cutter is often made impossible.

In any case a plurality of elongated packages are continuously fed in a line with no space therebetween, so that the packaging material of one elongated package may be cut and peeled from said package leaving the portions of said material not peeled between both ends of said package and adjacent packages.

Further, said eccentric rolls for peeling the packaging material off said package must be usually driven, thus shortening the life of said rolls.

Further-more, dust like pieces of said material generated at the time of cutting said material are floating about in the air to adhere to said product consisting of can ends, bottle caps or the like, so that said product must be later treated in a cleaner.

Still further, when a seamer for sealingly attaching can ends to both open ends of a can is connected to the line of automatically cutting and peeling the packaging material, said seamer must be arranged only one unit per each line. Accordingly, when a seamer having two stackers in which can ends are stacked is employed, it is necessary to connect two lines in parallel with said seamer. In addition, feeding speed from said line to said seamer must be matched the operation of said seamer, so that whenever any trouble occurs in said line, said seamer must be also stopped in operation, thus causing the working efficiency to be lowered.

It is therefore a primary object of the present invention to provide a method and apparatus for automatically cutting the packaging material of an elongated package containing a product and peeling said material from said package so as to bring out said product efficiently and reliably.

It is another object of the present invention to provide a method and apparatus for automatically cutting the packaging material of an elongated package containing a product and peeling said material from said package wherein the process of previously cutting the packaging material to form a cut line along the longitudinal axis thereof, separating the packaging material from the cut line and peeling said material from the elongated package, and deliver the product, which is now brought out from said package, to a next section is arranged to be an automatic and continuous process line.

A further object of the present invention is to provide a method and apparatus for automatically cutting the packaging material of an elongated package containing a product and peeling said material from said package wherein a cutter means of long life is employed so as to keep the exchange of cutter as few as possible and to enhance the working efficiency.

A still further object of the present invention is to provide a method and apparatus for automatically cutting the packaging material of an elongated package containing a product and peeling said material from said package wherein the process can be made full automatic to save the persons requested.

A still further object of the present invention is to provide a method and apparatus for automatically cutting the packaging material of an elongated package containing a product and peeling said material from said package wherein the product, which is now brought out from said package, can be delayed and stored on the way according to the delivering speed.

A still further object of the present invention is to provide a method and apparatus for automatically cutting the packaging material of an elongated package containing a product and peeling said material from said package wherein the products, which are now bought out from said packages, can be arranged and delivered in one or more line(s).

A still further object of the present invention is to provide a method and apparatus for automatically cutting the packaging material of an elongated package containing a product and peeling said material from said package wherein the packaging material of one elongated package can be peeled from said package without leaving any portions of said material between both ends of said package and adjacent packages.

A still further object of the present invention is to provide a method and apparatus for automatically cutting the packaging material of an elongated package containing a product and peeling said material from said package wherein dust-like pieces of the packaging material generated at the time when said packaging material is separated along its cut line and peeled from said package can be sucked and the products which are brought out from the packages, can be cleaned at the same time.

These and other objects as well as the merits of the present invention will be apparent from the following detailed description with reference to the accompanying drawings.

An embodiment of the present invention will be described with reference to FIGS. 1 through 18.

Figure 1:
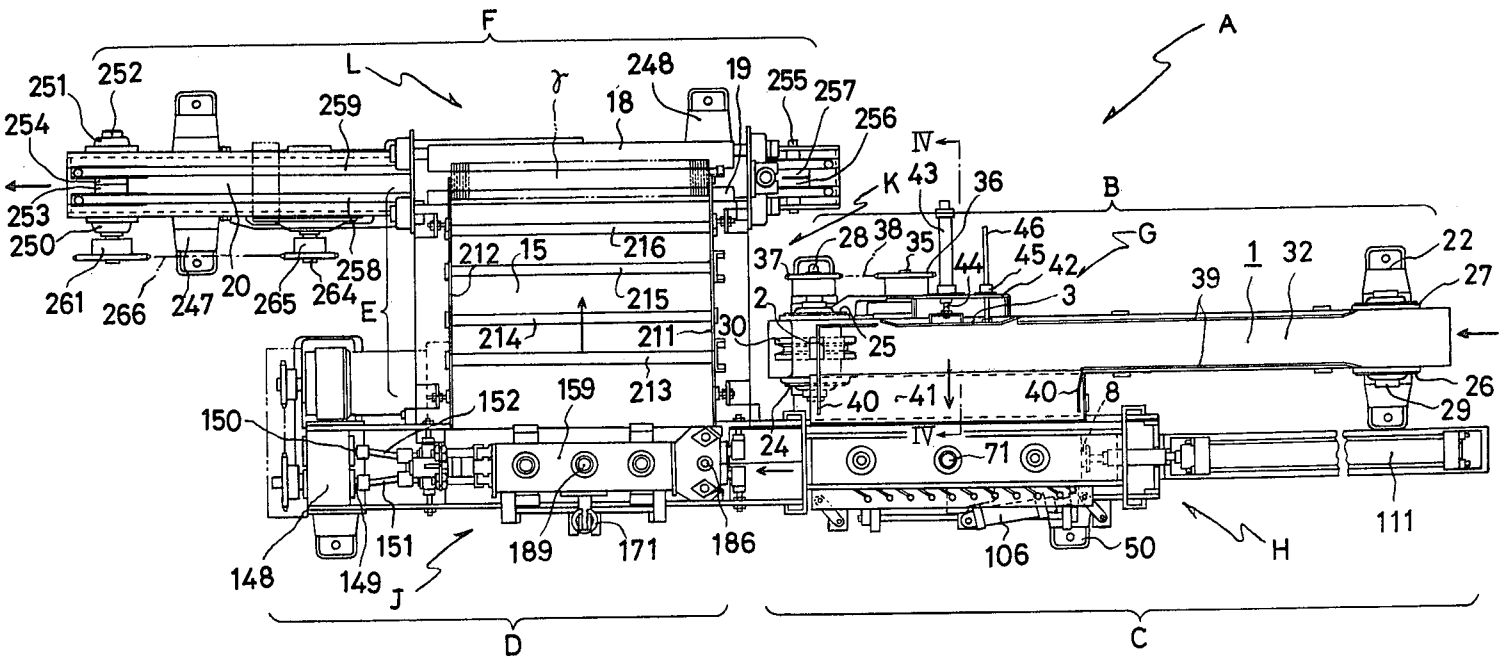
FIGS. 1 through 3 are a plan view, a partly omitted right side view and a partly omitted elevation view respectively showing the apparatus of the present invention.

As shown in FIG. 1, the apparatus (A) of the present invention is arranged to form a continuous process line and has a feeding section (B), a cutting section (C), a peeling section (D), a delaying section (E) and a delivering or discharging section (F).

Said feeding section (B) includes an intermittently feeding means (G) provided with a conveyor (1), a stopper (2) and a pusher member (3), said conveyor (1) feeding in longitudinal direction an elongated package ($\alpha$) lying on said conveyor (1), said stopper (2) locating and stopping at the end of said conveyor (1) said elongated package ($\alpha$) which is now intermittently fed by said conveyor (1), and said pusher member (3) feeding said package, which has been located and stopped by said stopper (2), to a certain position in said cutting section (C).

Said cutting section (C) includes a cutting means (H) provided with a lifting trough (4) which can move up and down and recieve one of said packages ($\alpha$) just fed from said intermittently feeding means (G); a group of pairs of grippers (5) and (6) which can be freely opened and closed to grip said package ($\alpha$) just lifted by said lifting trough (4) at the upper portion and along the longitudinal axis thereof (see FIG. 22); a cutter member (7) cutting the packaging material ($\beta$) of said package ($\alpha$) gripped by said group of grippers to form a continuous cut line ($\epsilon$) just below the gripped portion of said packaging material and along the longitudinal axis of said package ($\alpha$) (see FIG. 24); and a pushing member (8) which pushes the back end of said package ($\alpha$), whose packaging material was cut by said cutter member (7) to have a continuous cut line ($\epsilon$) formed, forcing said package ($\alpha$) to slide on said lifting trough (4) into a certain position in said peeling section (D).

Said peeling section (D) includes a peeling means (J) provided with a supporter (9) which supports resiliently the forward end of said package ($\alpha$); a gate supporter (10) which freely moves up and down to closely support the back end of said package ($\alpha$); pusher members (11) which push the package at both sides thereof with said continuous cut line ($\epsilon$) located therebetween and at the upper portions adjacent to both ends of said package ($\alpha$) (see FIG. 25); a pair of rolls (12) and (13) on which said package ($\alpha$) is mounted and serving to roll in the packaging material ($\beta$) of said package between said rolls; and a chamber (14) which accommodates said package ($\alpha$) and swings to discharge the product contained in said package ($\alpha$) into said delaying section (E).

Said delaying section (E) includes a delaying and storing means (K) provided with an accumulator chute (15) which controls and guides both ends of said product ($\gamma$) just discharged from the peeling means (J) to deliver said product as a mass in dead weight fashion; and seesaw stoppers (16) and (17) which alternately project through the base of said chute to shift-transfer said product ($\gamma$) stepwise and in sequence.

Said delivering or discharging section (F) includes a discharging means (L) provided with a pair of flappers (18) and (19) which are freely swingable and temporarily receive said product ($\gamma$) just fed from said delaying and storing means (K); and a rope conveyor (20) onto which said product ($\gamma$) is dropped by the swinging action of said flappers and conveying said product ($\gamma$) to a seamer (not shown).

Said intermittently feeding means (G), cutting means (H), peeling means (J), delaying and storing means (K) and delivering or discharging means (L) are connected one another to form a continuous process line.

Said conveyor (1) comprises a conveyor frame (23) which is horizontally supported by front and back foot columns (21) and (22); a slat belt (32) endlessly running between a drive wheel (30) and a drive wheel (31) which are fixed to a driving shaft (28) and a driven shaft (29), respectively, said driving shaft (28) and driven shaft (29) being supported through bearings (24), (25) and (26), (27) which are attached to both out sides of said conveyor frame (23) at the front and back ends thereof; and a driving chain (38) endlessly running between a sprocket (36) and a sprocket (37) so as to transmit driving torque of a motor (34) through said chain to the driving shaft (28), said sprocket (36) being fixed to the outer end of a motor shaft (35) of said motor (34) mounted on a shelf plate (33) projecting like cantilever from the front foot column (21), and said sprocket (37) being fixed to the outer end of the driving shaft (28) penetrated through the bearing (25).

Except a certain portion at the forward end of the conveyor frame (23), parallel guiding plates (39) extend in longitudinal direction on both sides of the conveyor frame (23) with the slat belt (32) sandwiched therebetween, and said stopper (2) is arranged at the forward end of the conveyor (1) so as to stop the advancing of the package ($\alpha$).

Said package ($\alpha$) which has been stopped and positioned by means of said stopper (2) at the forward end of the conveyor is pushed one at a time by means of said pusher member (3) over a slant plate (41) bridging one side of the forward end of the conveyor (1) and said cutting means (H) and having parallel guiding plates (40), which are arranged at both ends of the slant plate (41) so as to control and guide both ends of the package ($\alpha$).

Said pusher member (3) of bow shape is fixed at the center thereof to the outer end of a piston rod (44) freely reciprocatingly inserted into an air cylinder (43) and at one side thereof to one end of a slide rod (46) so as to reciprocate crossing the slat belt (32) at the forward portion of the conveyor frame (23), said air cylinder (43) being penetrated through a bracket (42) at the front end thereof, said bracket being attached to the outer side of the conveyor frame (23) and parallel to the side thereof, and said slide rod (46) being penetrated through a guide sleeve (45) which is also penetrated through the bracket (42). In the Figures reference numerals (47) and (48) represent tension wheels.

Said cutting means (H) and peeling means (J) are connected integral with each other in a line and supported by front and back foot columns (49) and (50) to keep frames (51) and (52) horizontally.

Figure 6:
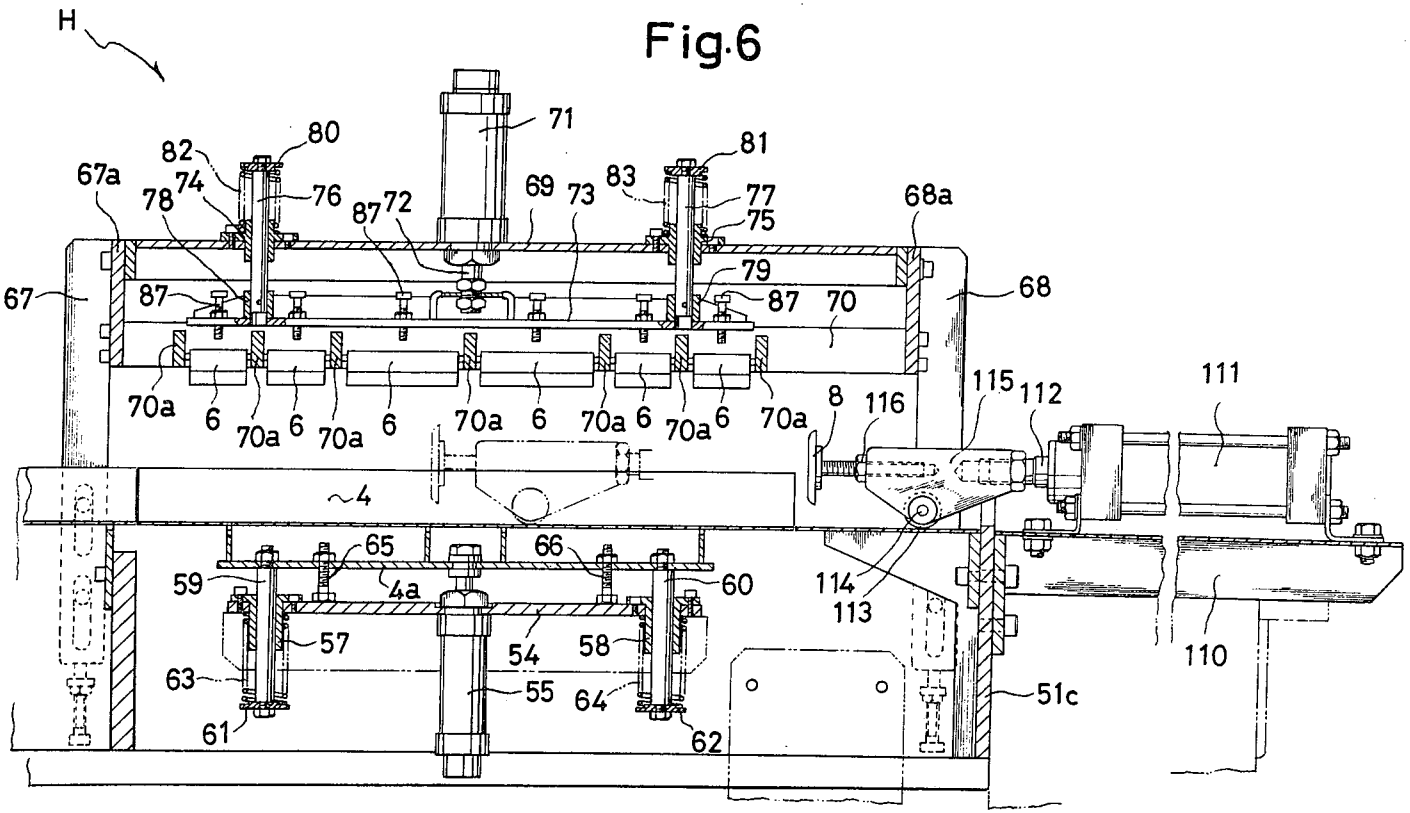
FIG. 6 is a cross section of the cutting means shown in FIG. 5 and taken along the line VI—VI in FIG. 7.
Figure 7:
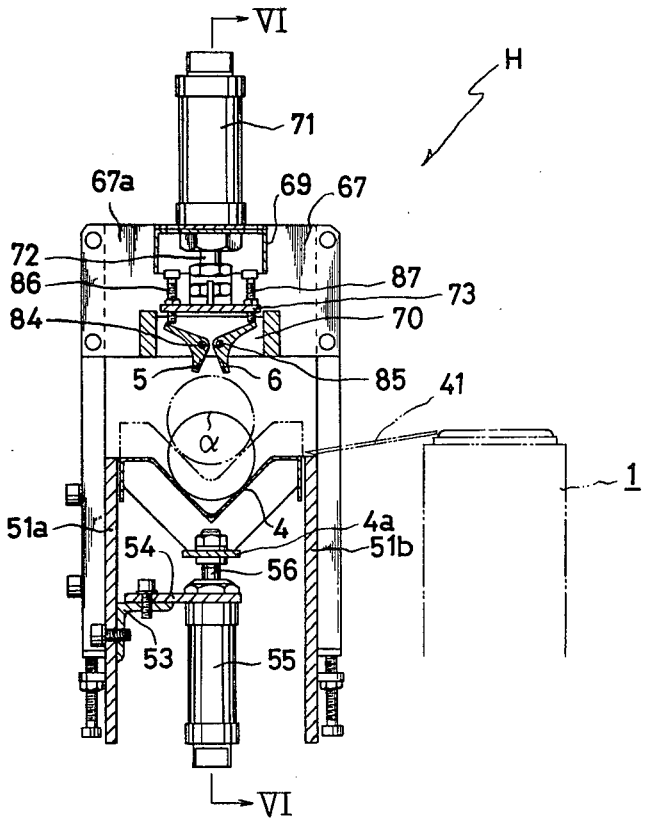
FIG. 7 is a cross section of the cutting means shown and taken along the line VII—VII in FIG. 5.

As shown in FIGS. 6 and 7, the lifting trough (4) has a V-shaped section into which the packages are received one at a time. Said lifting trough (4) is fixed at the underside and center thereof to the upper end of a piston rod (56) reciprocating up and down in a trough driving air cylinder (55) which is hung from a plate (54) penetrating through the center of said plate (54), said plate (54) being fixedly attached at one side thereof to a bracket (53) of reversed L-shape which is attached to and horizontally along the inner face of a left-side frame (51*a*) of the frame (51). Said lifting trough (4) is also fixed at the underside and back and front end portions thereof to the upper ends of slide rods (59) and (60) freely slidably penetrating through a pair of guide sleeves (57) and (58), respectively, which are hung from the back and front end portions of the plate (54). Coil springs (63) and (64) are inserted between the plate (54) and a spring seat (61) screwed to the lower end of the slide rod (59) and between the plate (54) and a spring seat (62) screwed to the lower end of the slide rod (60), thus usually urging the lifting trough (4) downward, but this downward movement of the lifting trough (4) is limited by stopper bolts (65) and (66) projecting downward from a plate (4*a*).

Figure 5:
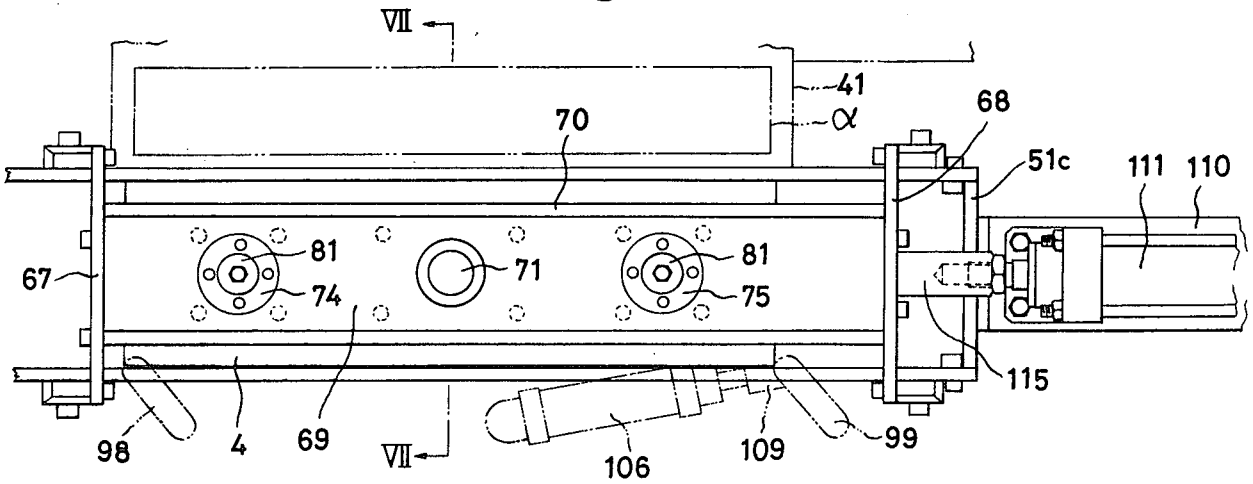
FIG. 5 is a plan view diagramatically showing a cutting means.

As shown in FIGS. 5 and 6, a roof plate (69) of reversed U-shape is arranged to be above a frame beam (70) of ladder shape, and said roof plate (69) and frame beam (70) are sandwiched between upper plates (67*a*) and (68*a*) of back and front gate-shaped frames (67) and (68), which bridge parallel side frames (51*a*) and (51*b*) attached to both ends of the frame (51). At the center of the roof plate (69) is erected a gripper driving air cylinder (71) into which a piston rod (72) is inserted so as to freely move up and down, and to the lower end of the piston rod (72) is fixed an action plate (73) at the center thereof, which is arranged just above the frame beam (70). Guide sleeves (74) and (75) are fixed in the roof plate (69) with the air cylinder (71) located therebetween and have slide rods (76) and (77) penetrated therethrough so as to allow said slide rods to slide up and down with their lower ends fixedly fitted in sleeves (78) and (79), which project from the action plate (73) at both ends thereof. Coil springs (82) and (83) are interposed between the roof plate (69) and a spring seat (80) attached to the upper end of the slide rod (76) and between the plate (69) and a spring seat (81) attached to the upper end of the slide rod (77), thus usually urging the action plate (73) upward. A pair of grippers (5) and (6) are pivoted by means of pins (84) and (85) between adjacent cross bars (70*a*) crossing the lower frame beam (70) and arranged symmetrical and movable in butterfly shape. A pair of action bolts (86) and (87) corresponding to a pair of grippers (5) and (6) are arranged in the action plate (73) along both sides thereof so that the lower ends of the action bolts may be freely brought into contact with the upper ends of their corresponding grippers and freely adjustable in their length projecting downward from the action plate (73). Accordingly, when the action plate (73) is lowered against the action of the coil springs (82) and (83), the lower ends of each pair of action bolts will be brought into contact with the upper ends of corresponding pair of grippers, causing the latter to be lowered to close the latter's lower ends.

Figure 8:
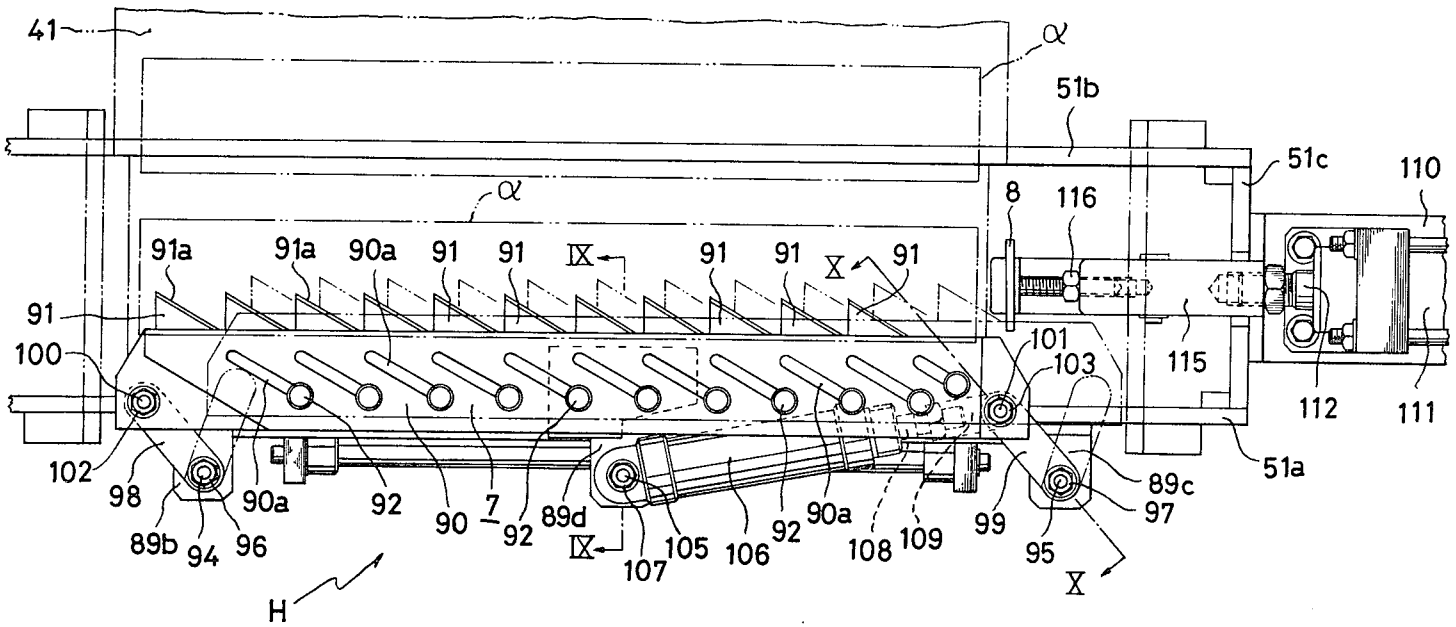
FIG. 8 is a plan view showing cutter members and a driving mechanism therefor provided in the cutting means.
Figures 9, 10, 11:
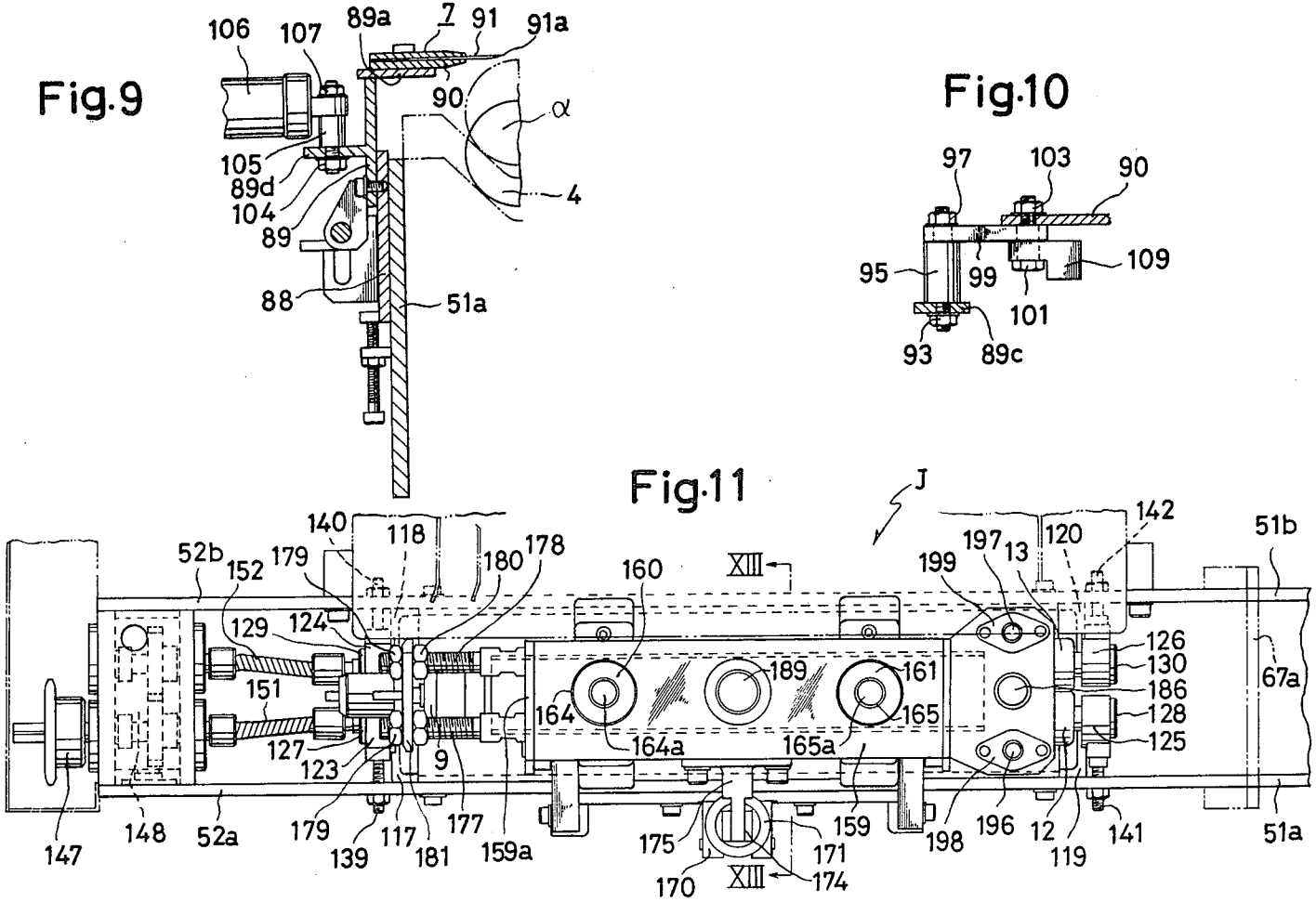
FIGS. 9 and 10 are cross sections taken along the lines IX—IX and X—X in FIG. 8, respectively.
FIGS. 11 and 12 are a plan view and a right side view respectively showing a peeling means.

As shown in FIGS. 8 through 10, the cutter member (7) comprises a cutting blade holder (90) freely slidably mounted on a sliding plate (89*a*) projecting inward from the center of an additional plate (89) which is attached to the upper outer side of the side frame (51*a*) with an intermediate plate (88) interposed therebetween; and a group of cutting blades (91) each being snapped along each notch to renew its blade tip (91*a*), freely slidable inserted into the cutting blade holder (90) along each slot (90*a*) thereof and fixedly held by a set screw (92) so as to keep the foremost end of the blade tips (91*a*) in a line. Stay shafts (94) and (95) erect on supporting plates (89*b*) and (89*c*) with their penetrated lower ends screwed by nuts (93), said supporting plates (89*b*) and (89*c*) projecting horizontally outward from the front and back ends on the additional plate (89), and links (98) and (99) whose one ends are commected to the upper ends of said stay shafts (94) and (95) by means of nuts (96) and (97) are pivoted at their other ends to the front and back ends of the cutting blade holder (90) by means of bolt pins (100), (101) and nuts (102), (103). A stay shaft (105) erects on a supporting plate (89*d*) with its penetrated lower end screwed by a nut (104), said supporting plate (89*d*) projecting horizontally outward from the center of the additional plate (89), and a cutter member driving air cylinder (106) is pivoted at the back end thereof to the upper end of the stay shaft (105) by means of nut (107). A piston rod (108) is freely slidably inserted into the cutter member driving air cylinder (106) and to the outer end of the piston rod (108) is fixed a head (109), which is attached to the lower end of the bolt pin (101), so that by the advancing movement of the piston rod (108) the cutting blade holder (90) will be slided on the sliding plate (89*a*) to move from the position shown in solid line in FIG. 8 to a position shown in imaginary line in FIG. 8, causing the group of cutting blades (91) to thrust their blade tips (91*a*) into the packaging material ($\beta$) of the package ($\alpha$) just below that portion thereof gripped by the grippers (5) and (6) and then to move in longitudinal direction to form a continuous cut line ($\epsilon$), while by the retreating movement of the piston rod (108) the cutting blade holder (90) will be slided on the sliding plate (89*a*) to return the original position.

As shown in FIGS. 6 and 8, a pusher member driving air cylinder (111) is fixed at the front and back ends thereof on a shelf bracket (110) extending horizontally outward from the outer upper side of an end frame (51*c*), and into the air cylinder (111) is freely slidably inserted a piston rod (112), to the outer end of which is fixed a head (115) having rolling wheels (113) rotatably supported by a shaft (114) at the base of the head (115). The pushing member (8) is screwed into a nut (116) fixed to the front end of the head (115) and serves to push the back end of the package ($\alpha$), whose packaging material has been cut and released from the gripped state, in the lifting trough (4) to the next peeling means (J).

Figure 12:
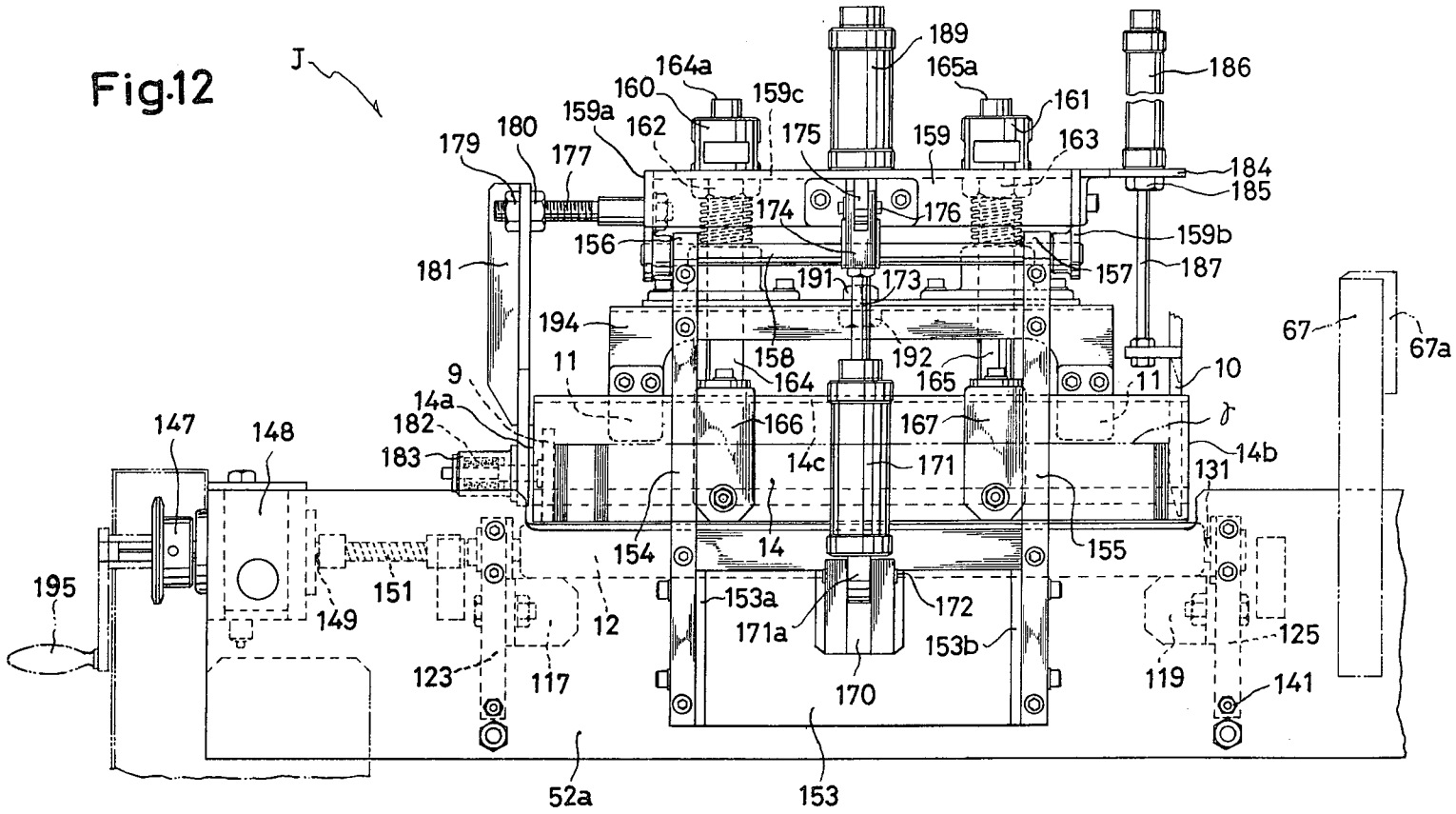
Figure 13:
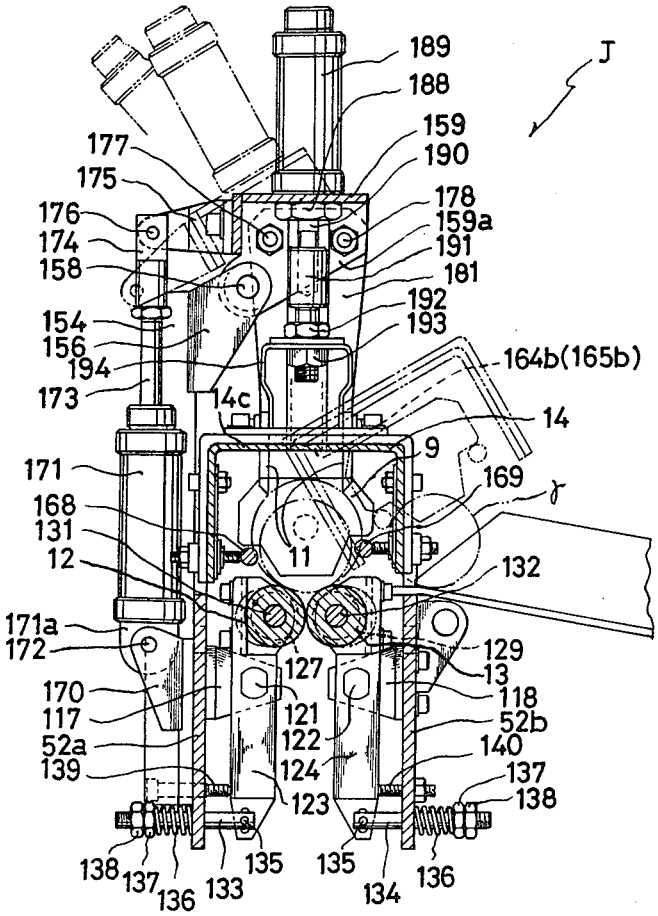
FIG. 13 is a cross section of the peeling means shown and taken along the line XIII—XIII in FIG. 11.

As shown in FIGS. 11 through 13, a pair of rolls (12) and (13) are fixedly attached to roll shafts (131) and (132) which extend horizontally parallel to each other and are freely rotatably supported at the both ends thereof by bearings (127), (128) and (129), (130), respectively, said bearings being fixed to their corresponding vertically parallel bearing holders (123), (124) and (125), (126) which are pivoted at the center thereof to supporting brackets (117) (118) and (119), (120) by means of rods (121) and (122) and said supporting brackets being attached to the inner faces of left and right parallel side frames (52*a*) and (52*b*) at the front and back ends of the peeling section (D). The bearing holders (123), (124) and (125), (126) are connected at the lower ends thereof to the inner ends of right and left tension rods (133) and (134) by means of pins (135), respectively, and to the outer end of each of the tension rods penetrated through the right or left side frame (52*a*) or (52*b*) are screwed double nuts (137) and (138) with a coil spring (136) interposed between the double nuts and right or left side frame, so that the left-sided bearings (127), (129) fixed to the upper portions of the left side bearing holders (123), (125) and the right side bearings (128), (130) fixed to the upper portions of right side bearing holders (124), (126) are urged to act lever-like action centering the rods (121) and (122), respectively, to be brought into contact with stoppers (139), (141) and (140), (142) and causing the pair of rolls (12) and (13) to come close each other at the same time. The level of said pair of rolls (12) and (13) is arranged to be same as the lower level of the lifting trough (4) provided in the cutting means (H), thus allowing the package ($\alpha$) fed from the trough (4) to be directly received by the rolls. The driving torque generated by a motor (144), which is mounted on a shelf plate (143) fixed like cantilever to the foot column (49), is transmitted to the pair of rolls (12) and (13) through a driving chain (146) endlessly running between a sprocket wheel (145) of the motor (144) and a sprocket (147) of a distributor (148), output shafts (149) and (150) of the distributor (148), universal joints (151) and (152), and the roll shafts (131) and (132). Said roll shafts are supported parallel to each other and rotated opposite to each other.

As shown in FIGS. 11 through 13, bearing brackets (156), (157) slantly project from the upper ends of respective supporting bars (154), (155), which erect along the front and back end portions (153*a*), (153*b*) of a plate (153) attached to the outer face of the left side frame (52*a*), and to both ends of a shaft (158) penetrated through the bearing brackets (156), (157), respectively, and supported therebetween are pivoted the foremost ends of end plates (159*a*), (159*b*) projected slantly and sideways from both ends of a frame (159). The upper openings (164*a*), (165*a*) of hollow rods (164), (165) are penetrated through valve bodies (160), (161), each containing an air adjusting valve therein, to open at the front and back portions of the frame (159) and these hollow rods (164), (165) are suspended from the frame (159) by means of nuts (162), (163). The chamber (14) having a section of reversed U-shape is horizontally fitted to and between frames (166), (167) of reversed U-shape, through which are penetrated the lower dust collecting openings (164*b*), (165*b*) of the suspended hollow rods (164), (165), so as to house the package ($\alpha$) one at a time therein. Guide rods (168), (169), which serve to control and guide the package ($\alpha$), are projected opposite to each other from the lower portions of both sides of the chamber (14). The suspended hollow rods (164), (165) have their upper end openings (164*a*), (165*b*) connected to a vacuum source (not shown) and their lower end dust collecting openings (164*b*), (165*b*) arranged to open at a roof (14*c*). A piston rod (173) is freely slidably inserted into a chamber swinging air cylinder (171) whose tail end (171*a*) is inserted between the forked portions of a bracket (170) attached to the central upper portion of the plate (153), and to a forked head (174) fixed to the outer end of the piston rod (173) is pivoted by means of a pin (176) a connecting member (175) which projects from one side and upper central portion of the frame (159), so that by the downward movement of the piston rod (173) the frame (159) and the chamber (14) are swung to move from the position shown in solid line to a position shown in an imaginary line in FIG. 13 and to separately house the product ($\gamma$), from which the packaging material ($\beta$) has been peeled, to be discharged as a mass to the next delaying and storing means (K).

As shown in FIGS. 11 and 12, a vertical plate (181) is hung by means of nuts (179), (180) from free ends of a pair of rods (177), (178), which project parallel to each other from the front end plate (159*a*) of the frame (159). A sleeve (183) housing a coil spring (182) therein is projected from the lower outer side of the vertical plate (181). The stopper (9) freely resiliently inserted into the sleeve (183) through the lower end of the vertical plate (181) is arranged to position in the front end opening (14*a*) of the chamber (14) and to swing integral with the chamber (14).

As shown in FIGS. 11 and 12, the gate supporter (10) is fixed to the lower end of a piston rod (187), which is freely slidably inserted into a gate driving air cylinder (186) and arranged to move integral with the piston rod (187) to freely close and open the back end receiving opening (14*b*) of the chamber (14) as well as to swing integral with the chamber (14), said air cylinder (186) being reversedly erected on the center of a bracket (184) with its lower end screwed by a nut (185) and said bracket (184) projecting from the back end plate (159*b*) of the frame (159).

As shown in FIGS. 11 through 13, a piston rod (190) is freely slidably inserted into a pushing member driving air cylinder (189), which is reversedly erected on the center of the roof (159*c*) of the frame (159). The pushing members (11) are projected downward from both ends and both sides of a pushing frame (194) and penetrated through the roof (14*c*) of the chamber (14) so as to freely move in and out of the chamber (14), said pushing frame (194) being fixed at the center thereof by means of nuts (192), (193) to the lower end of a head (191) screwed into the lower end of the piston rod and extending above and along the roof (14*c*) of the chamber (14). The pusher members (11) is arranged to swing integral with the frame (159), chamber (14) and pushing frame (194). When the piston rod (190) is lowered intermittently, the pusher members (11) are intermittently brought into contact with the package ($\alpha$) at the both sides and back and front ends thereof with the continuous cut line (ε)interposed therebetween so as to allow the packaging material (β) of the package (α) mounted on the rolls (12), (13) and housed in the chamber (14) to be rolled in between the rolls (12) and (13). In the Figures numeral (195) represents a freely detachable manual handle, and (196), (197) guide rods penetrating through guide sleeves (198), (199) arranged at both sides of the bracket and guiding the gate supporter (10).

Figure 14:
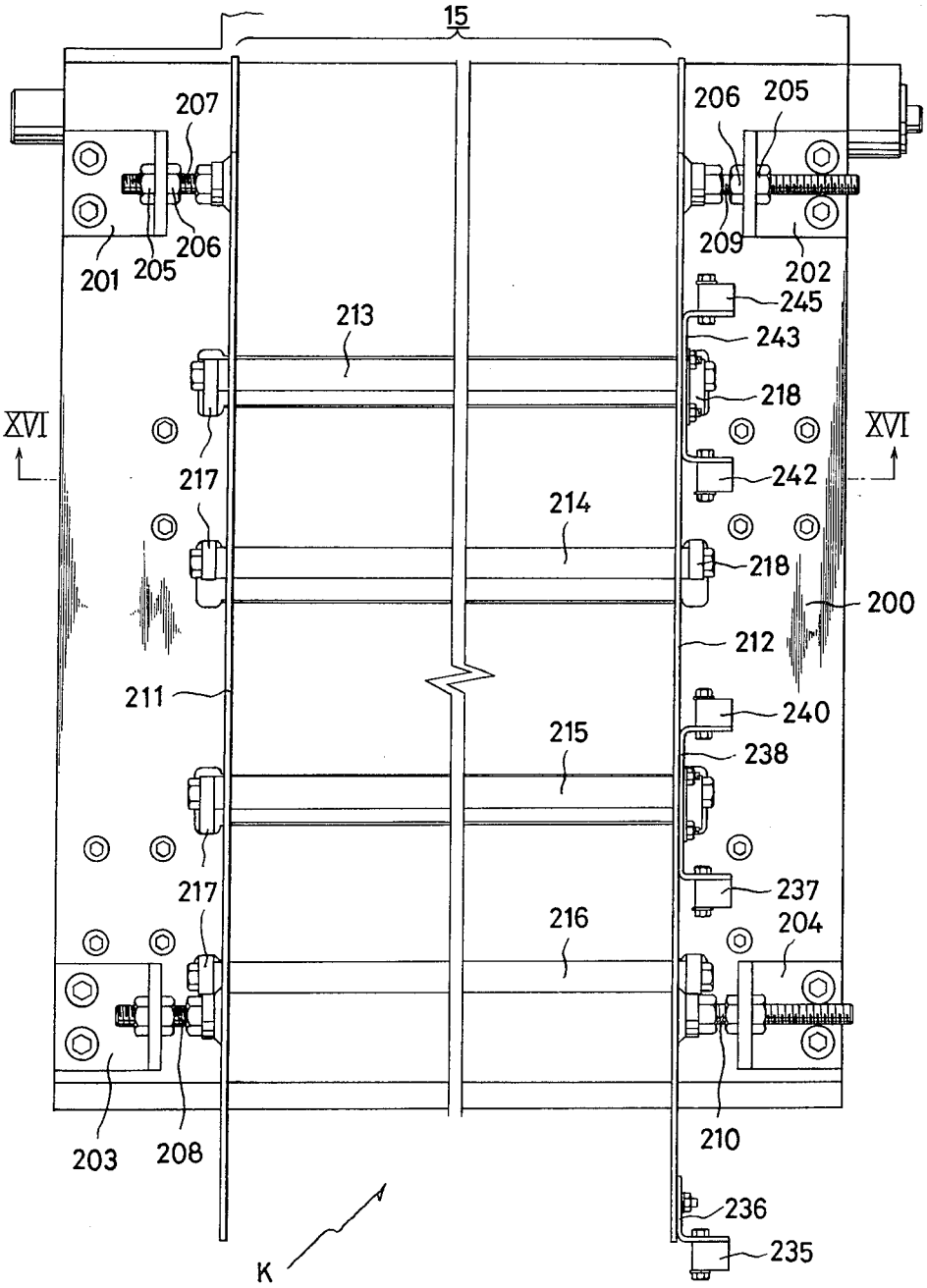
FIGS. 14 and 15 are a plan view and a right side view respectively showing a delaying and storing means.
Figure 15:
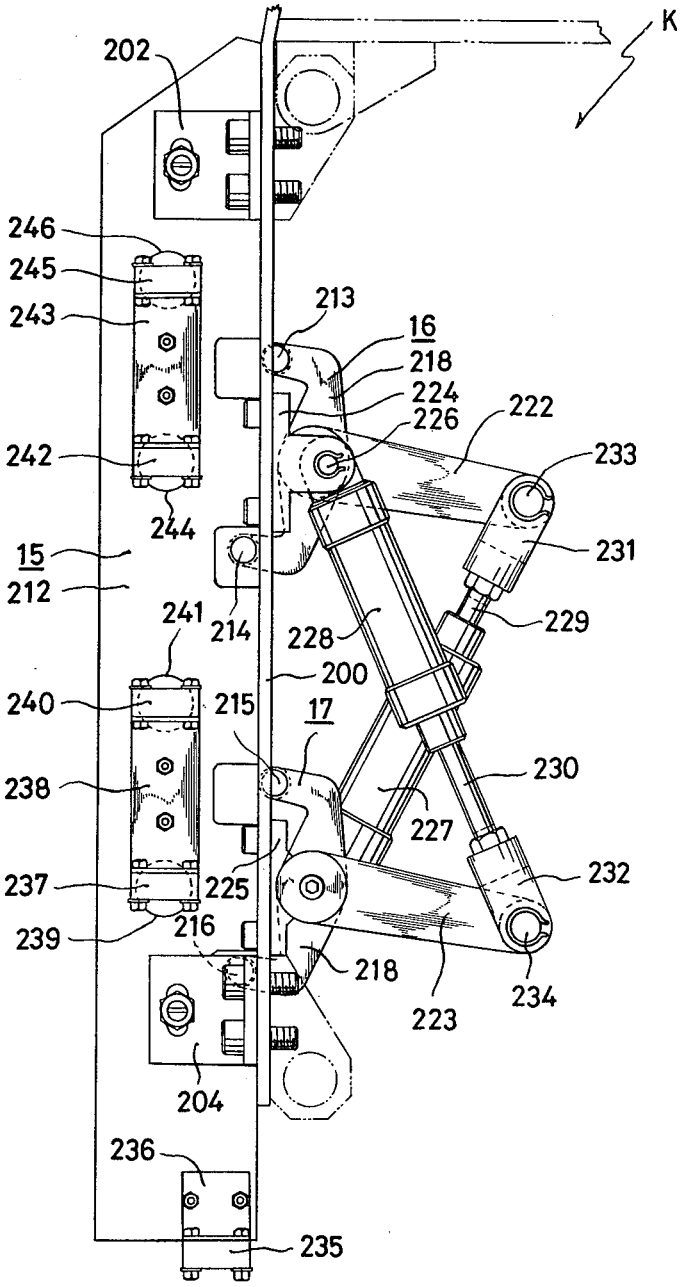
Figure 16:
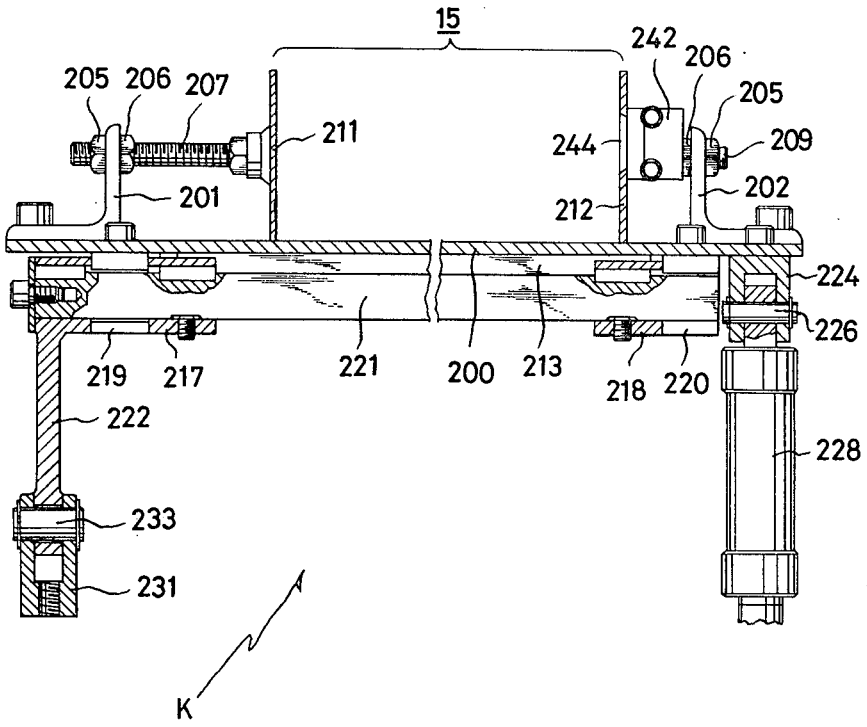
FIG. 16 is a cross section of the delaying and storing means taken along the line XVI—XVI in FIG. 14.
Figure 17:
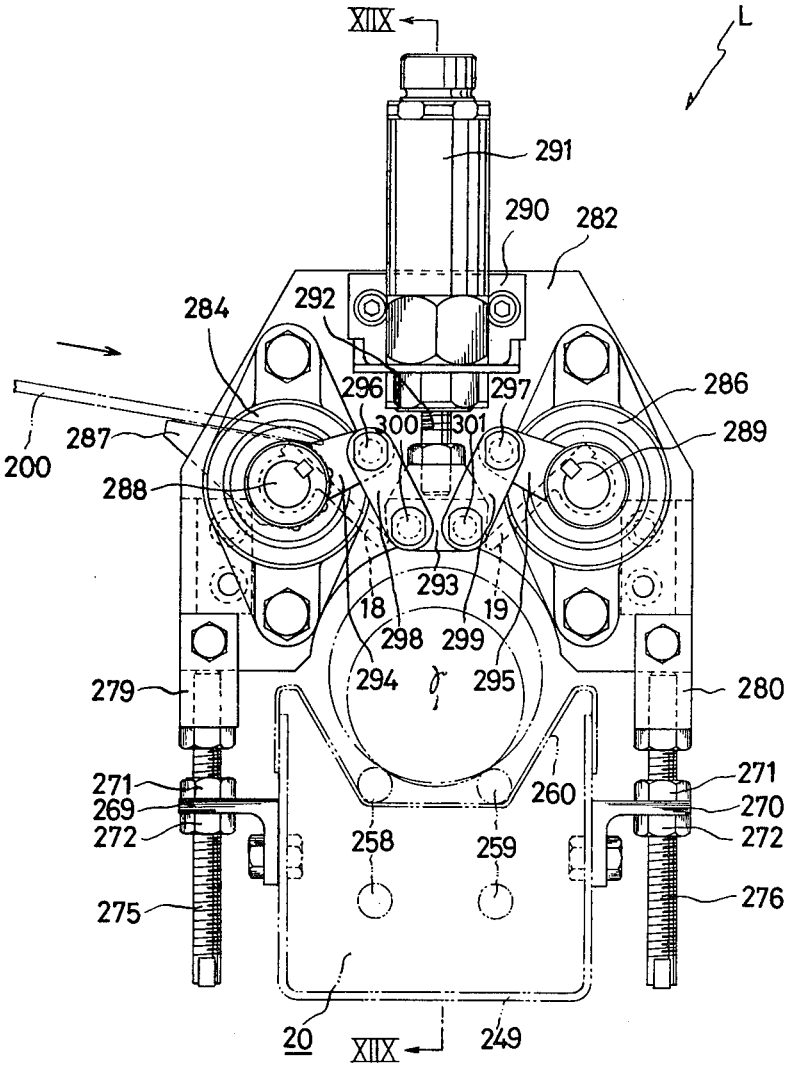
FIG. 17 is a back-side view showing an embodiment of delivering or discharging means.
Figure 18:
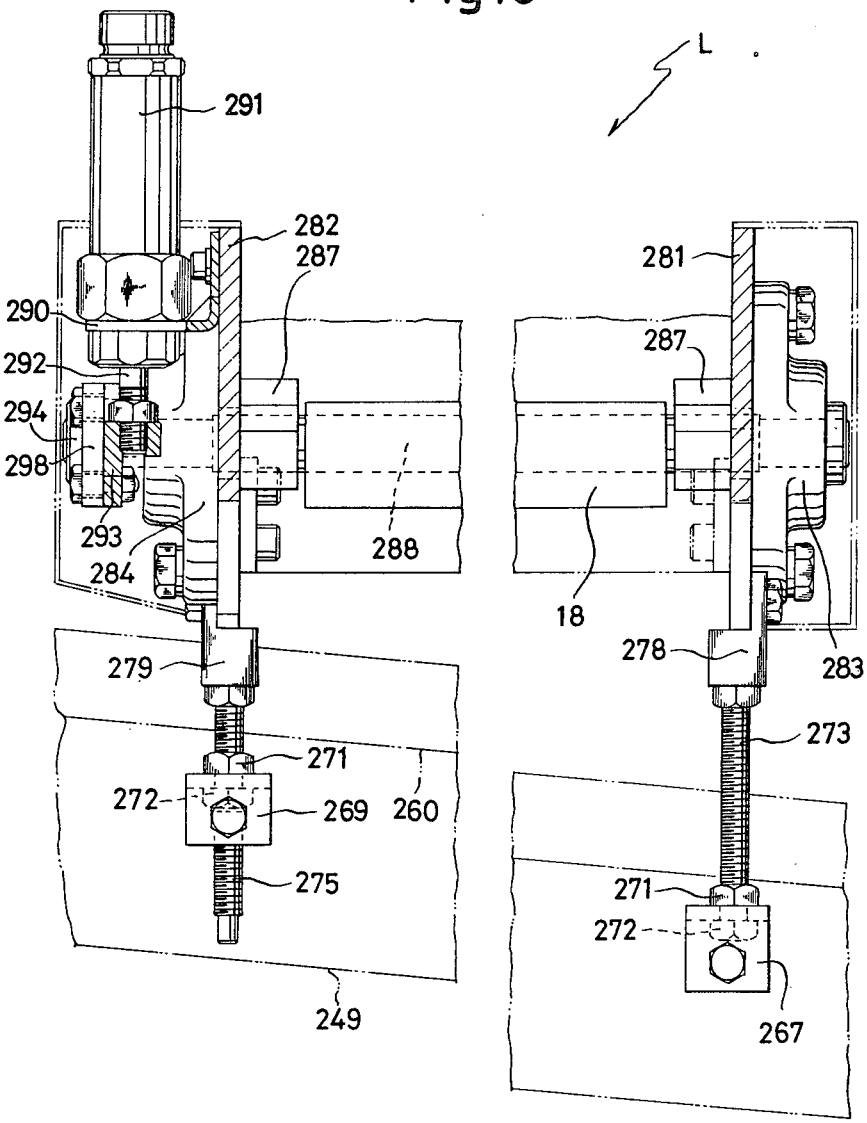
FIG. 18 is a cross section of the delivering or discharging means taken along the line XIIX—XIIX in FIG. 17.

As shown in FIGS. 14 through 16, accumulator chute (15) is arranged between supporting rods (207), (208) and (209) (210), which are penetrated through L-shaped stoppers (201), (202), (203), (204), respectively, and adjustably fastened thereto by means of nuts (205), (206), said L-shaped stoppers being fixed on four corners of base plate (200) slantly bridging the peeling means (J) and discharging means (L), and a pair of end guide plates (211), (212) are opposed each other with a space equal to the length of the mass-like product (γ) interposed therebetween. Therefore, the product (γ) is allowed to regularly roll down due to its dead weight.

As shown in FIGS. 14 and 15, first and second seesaw stoppers (16), (17) are arranged to allow stopper rods (213), (214), (215) and (216) to alternately project upward through the base plate (200) of the accumulator chute (15) with a predetermined space therebetween, so that the rolling-down product (γ) is transferred from the upper stopper rod (213) to the lowest one (216) in order and in delayed fashion. A pair of forked lever members (217), (218), to which both ends of each of the stopper rods (213), (214), (215) (216) are fixed, respectively, are coaxially fixed to respective lever shafts (221), whose both ends are penetrated through left and right side pillow blocks (219), (220) and rotatably supported therebetween, said pillow blocks projecting downward from both sides of the underside of the base plate (200). To one end of the lever shaft (221) is fixed the upper end of each of links (222), (223) and the lower ends of said links (222) (223) are pivoted to heads (231), (232) by means of connecting pins (233), (234), said heads being fixed to the outer ends of piston rods (229), (230) freely slidably inserted into seesaw driving air cylinders (227), (228) and said seesaw driving air cylinders being inserted into forked brackets (224), (225) and pivoted thereto by means of pin (226), said brackets projecting downward from the underside of the base plate (200) adjacent to the other end of the lever shaft (221). Therefore, the reciprocation of the piston rods (229), (230) is transmitted through the links (222), (223) and each of the lever shafts (221) to the first and second seesaw stoppers (16), (17), so that the lever action of the pair of left and right lever members (217), (218) allows either the stopper rods (213), (214) or (215), (216) to be penetrated above the base plate (200) defined by the end guide plates (211), (212) as well as either the stopper rods (213), (215) or (214), (216) to be penetrated above or retreated through the base plate (200).

In the Figures, numeral (235) represents a proximity switch attached to the outer face of the right end guide plate (212) by means of fittings (236) and serving to detect that no mass-like product (γ) is on the pair of left and right flappers (18), (19) in the delivering or discharging means (L), to change-over the seesaw driving cylinder (228), to retreat the piston rod (229), to cause the left and right lever members (217), (218) to act lever-like action in counterclockwise direction, and finally to retreat the stopper rod (216); (237) a proximity switch attached to the left side end of a fixing metal (238) attached to the outer face of the right end guide plate (212), and serving to detect through a circular window (239) of the right end guide plate (212) that no mass-like product (γ) is stopped and supported by the stopper rod (216), to change-over the second seesaw driving cylinder (228), to advance the piston rod (230), to cause the left and right forked lever members (217), (218) of the second seesaw stopper (17) to act lever-like action in clockwise direction, and finally to project the stopper rod (216); (240) a proximity switch attached to the right side end of the fixing metal (238) and serving to detect through a circular window (241) of the right end guide plate (212) that no product (γ) is stopped and supported by the stopper rod (215), to simultaneously change-over the first and second seesaw driving cylinders (227), (228), to retreat the piston rod (230) while advancing the piston rod (229), to cause the left and right forked lever members (217), (218) of the second seesaw stopper (17) to act lever-like action in counterclockwise direction while causing the left and right forked lever members (217), (218) of the first seesaw stopper (16) to act lever-like action in counterclockwise direction, and finally to project the stopper rod (215) at the same time when the stopper rod (214) is retreated; (242) a proximity switch attached to the left side end of a fixing metal (243) attached to the outer face of the right end guide plate (212) and serving to detect through a circular window (244) of the right end guide plate (212) that no mass-like product (γ) is stopped and supported by the stopper rod (214), to change-over the first seesaw driving cylinder (227) to retreat the piston rod (229), to cause the left and right forked lever members (217), (218) of the first seesaw stopper (16) to act lever-like action in clockwise direction, and finally to retreat the stopper rod (213); and (245) a proximity switch attached to the right side end of the fixing metal (243) and serving to detect through a circular window (246) of the right end guide plate (212) that no product (γ) is stopped and supported by the stopper rod (213), to change-over the first seesaw driving cylinder (227), to advance the piston rod (229), to cause the left and right forked lever members (217), (218) of the first seesaw stopper (16) to act lever-like action in counterclockwise direction, and finally to project the stopper rod (213). Proximity switches (235), (237) (240), (242), (245) and a changeover control circuit (not shown) for the first and second seesaw driving cylinders (227), (228) are logically connected not to interfere with one another.

As shown in FIGS. 1, 3, 17 and 18, the rope conveyor (20) supported by front and back foot columns (247), (248) at the front and back end portions thereof comprises a conveyor frame (249) inclined downward at the terminal end of said conveyor (20); a pair of driving wheels (253), (254) coaxially fixed to the center of a driving shaft (252), whose both ends are supported by right and left bearings (250), (251) attached to both outer sides and at the terminal end of said conveyor frame; a pair of driven wheels (256), (257) freely rotatably attached to a shaft (255) which is fixed at both ends thereof to both sides and at the starting end of said conveyor frame (249); a pair of parallel conveyor ropes (258), (259) endlessly running between the driving wheels (253), (254) and the driven wheels (256), (257); a guiding trough (260) covering the whole length of the upper opening of the conveyor frame (294) and along which the conveyor ropes (258), (259) running upside are exposed; a sprocket (261) fixed to the penetrated outer end of the driving shaft (252); a sprocket (265) fixed to the outer end of a motor shaft (264) of a motor (263) mounted on a shelf plate (262) projecting like cantilever from the front foot column (247); and a driving chain endlessly running between the sprockets (261) and (265) so as to transmit the driving torque of the motor (263) to the driving shaft (252) to which the driving wheels (253) and (254) are fixed.

As shown in FIGS. 1, 3, 17 and 18, front and back pairs of fallen L-shaped brackets (267), (268) and (269), (270) are projected from both outer sides of the conveyor frame (249) adjacent to the starting end thereof with a space equal to the width of the base plate (200) of the accumulator chute (15) interposed between said front and back pairs, and front and back pairs of supporting screw rods (273), (274) and (275), (276) are penetrated through said brackets (267), (268) and (269), (270), respectively, to be vertically adjustably fixed thereto by means of a pair of nuts (271), (272). Front and back arch plates (281) and (282) bridge fixing heads (277), (278) and (279), (280), which are fixed to the upper ends of said supporting screw heads (273), (274) and (275), (276), respectively. The pair of left and right flappers (18) and (19) are symmetrically projected downward from the inner sides of flapper shafts (288) and (289), which are supported between bearing blocks (283) and (284), and between bearing blocks (285) and (286), respectively, through brackets (287) for connecting the base plate (200) of the accumulator chute (15) and through the arch plates (281), (282), and said bearing blocks (283), (284) and (285), (286) are attached to both outer sides of the arch plate (281) and (282). A piston rod (292) is freely slidably inserted into a flapper driving cylinder (291), which erects reversedly on a L-shaped bracket (290) attached to the outer upper central portion of the arch plate (282), and a fixing head (293) fixed to the lower end of the piston rod (292) is symmetrically pivoted by means of pins (300), (301) to one ends of links (298), (299) which are connected by means of pins (296), (297) at the other ends thereof to the foremost ends of arms (294), (295) fixedly projecting from the penetrated ends of the flapper shafts (288), (289), respectively. Therefore, the downward movement of the piston rod (292) is transmitted through the toggle joint mechanism, which comprises the arms (294), (295) and links (298),(299), to the flapper shafts (288), (289), respectively, and the flapper shafts (288) and (289) are then rotated opposite to each other causing the flappers (18) and (19) to open to drop onto the guiding trough (260) of the rope conveyor (20) the mass-like product ($\gamma$), which was temporarily received by the flappers (18) and (19). When the mass-like product ($\gamma$) is dropped onto the guiding trough (260), the piston rod (292) is retreated upward causing the flappers (18) and (19) to be closed, ready again for receiving a next mass-like product ($\gamma$) from the accumulator chute (15).

Figure 19:
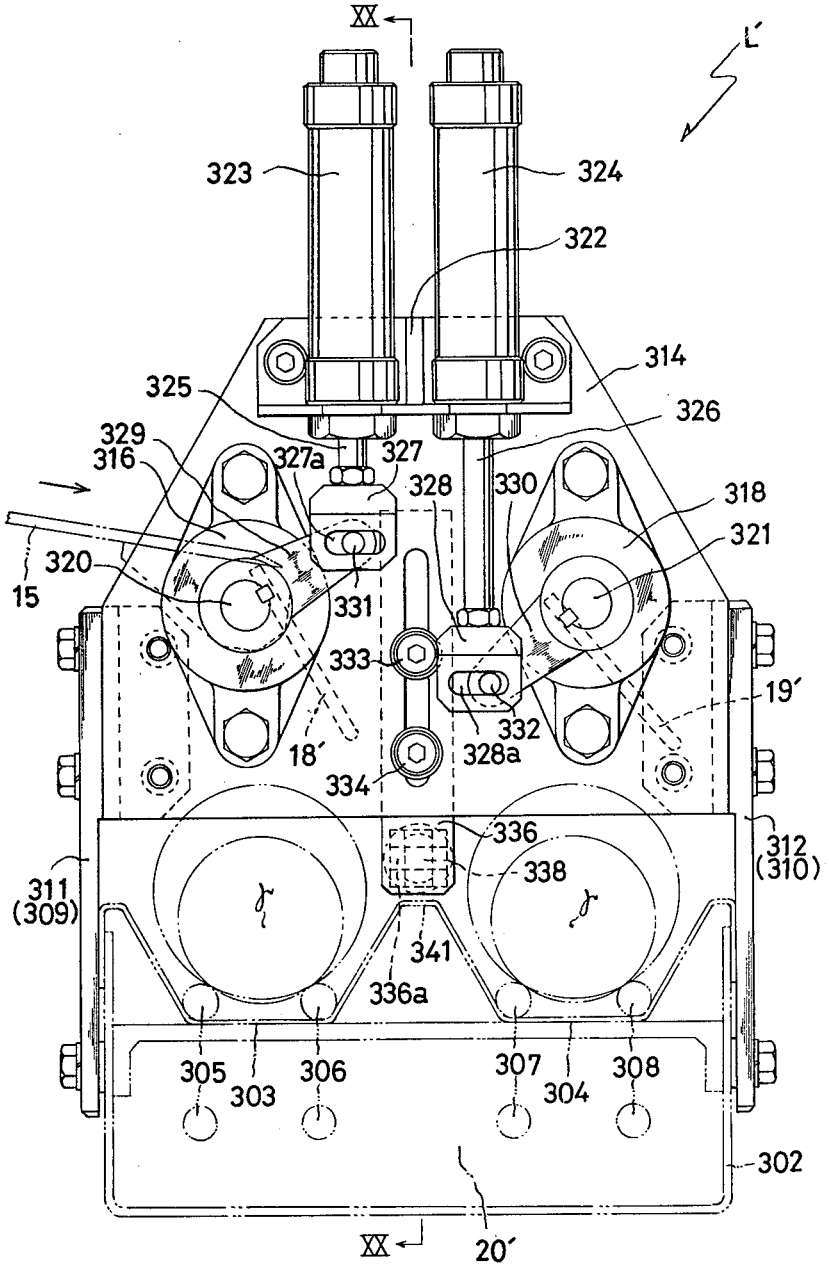
FIG. 19 is a back-side view showing another embodiment of delivering or discharging means.
Figure 20:
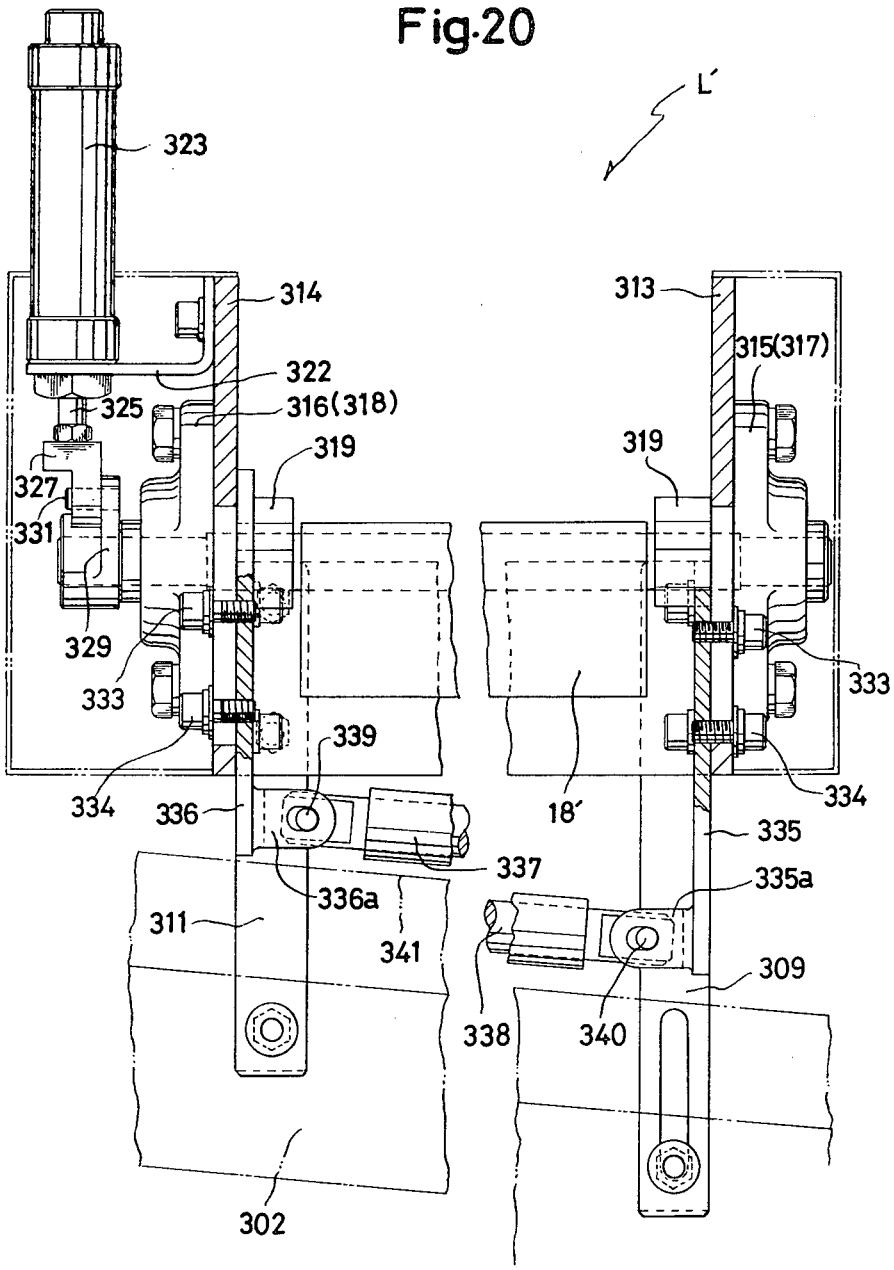
FIG. 20 is a cross section of the delivering or discharging means taken along the line XX—XX in FIG. 19.

Another embodiment of delivering or discharging means (L') will be described with reference to FIGS. 19 and 20.

This embodiment of discharging means (L') comprises a pair of freely swingable flappers (18') and (19'), which temporarily receive the product ($\gamma$) fed from the delaying and storing means (K), and a rope conveyor (20'), onto which the products ($\gamma$) are distributively dropped either in left or right direction by the swinging movement of each of the tlappers (18') and then serves to discharge the products ($\gamma$) to the seamer (not shown).

The rope conveyor (20') comprises a conveyor frame (302), which is supported at the front and back portions thereof by front and back foot columns (247), (248) (not shown) and inclined toward the terminal end thereof, guiding troughs (303), (304) which are same in construction as that in the rope conveyor (20) and arranged parallel to each other, and conveyor ropes (305), (306) and (307), (308), whose portions running upside are exposed along the guiding troughs (303) and (304), respectively.

Front and back pairs of supporting bars (309),(310) and (310), (312) are vertically adjustably attached to both outer sides of the conveyor frame (302) and adjacent to the starting end thereof with a space equal to the width of the base plate (200) of the accumulator chute (15) interposed between the front and back pairs thereof, and a pair of front and back plates (313) and (314) bridge the upper portions of front supporting bars (309) (310) and those of back supporting bars (311), (312), respectively. Parallel flapper shafts (320), (321) are supported by bearing blocks (315), (316) and by bearing blocks (317), (318), respectively, through brackets (319) for connecting the base plate (200) of the accumulator chute (15) and through the plates (313), (314), said supporting blocks being fixed to both outer sides of each of the plates (313), (314), and left and right flappers (18'), (19') are projected slightly downward from the inner sides of the flapper shafts (320), (321). Piston rods (325), (326) are freely slidably inserted into a pair of left and right flapper driving cylinders (323) (324), which are reversedly erected on a L-shaped bracket (322) attached to the outer upper central portion of the plate (314), and connecting slots (327*a*), (328*a*) provided in fixing heads (327), (328) attached to the lower ends of the piston rods (325), (326) are engaged with pins (331), (332) projecting from the foremost ends of arms (329), (330) which are fixedly projected from the penetrated ends of the flapper shafts (320), (321). Vertical bars (335), (336) are vertically adjustably attached by means of bolts (333), (334) to the inner lower central portion of the plates (313) (314), respectively, and both ends of a partition rod (338) covered by resilient polyurethane (337) are connected by means of pins (339), (340) to forked projections (335*a*), (336*a*) projected from the opposing lower ends of the vertical bars (335), (336), said partition rod exterding along a boundary portion (341) between the parallel inclined guiding troughs (302) and (303). Therefore, when downward movement of the piston rod (325) causes the flapper shaft (320) to be rotated integral with the flapper (18') in clockwise direction, the product ($\gamma$) temporarily received by the flappers (18'), (19') is mounted on the partition rod (338) and then dropped in one guiding trough (303). After then, the piston rod (325) is retreated upward causing the flapper (18') to be swung to the original closed position. On the other hand, when downward movement of the piston rod (326) causes the flapper shaft (321) to be rotated integral with the flapper (19') in couter-clockwise direction, the product ($\gamma$) temporarily received by the flappers (18'), (19') is mounted on the partition rod (338) and then dropped in the other guiding trough (304). After then, the piston rod (326) is retreated upward causing the flapper (19') to be swung to the original closed position. The pair of left and right flappers (18') and (19') are now ready again for receiving a next product fed from the accumulator chute (15).

Figure 2:
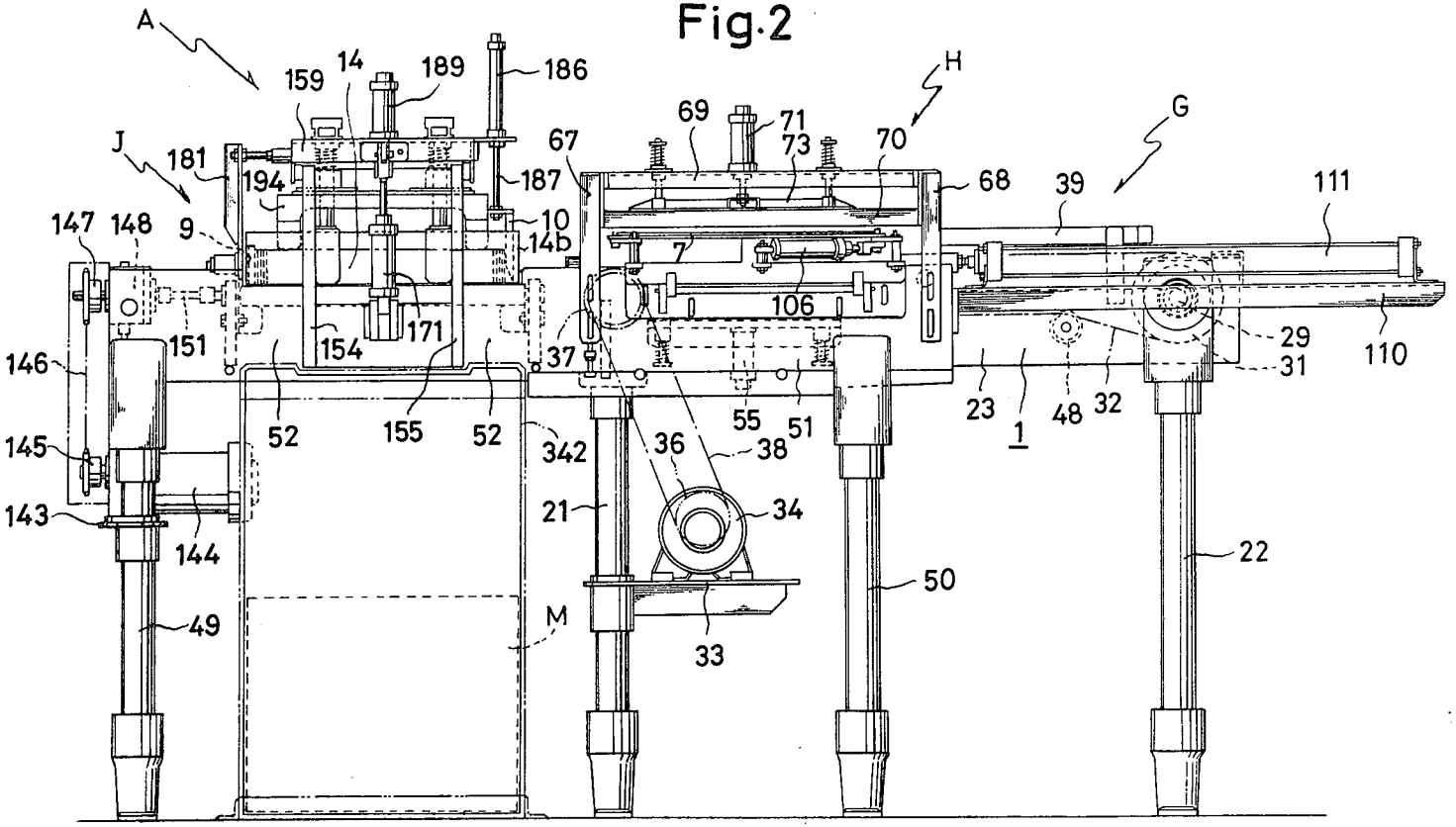
Figure 3:
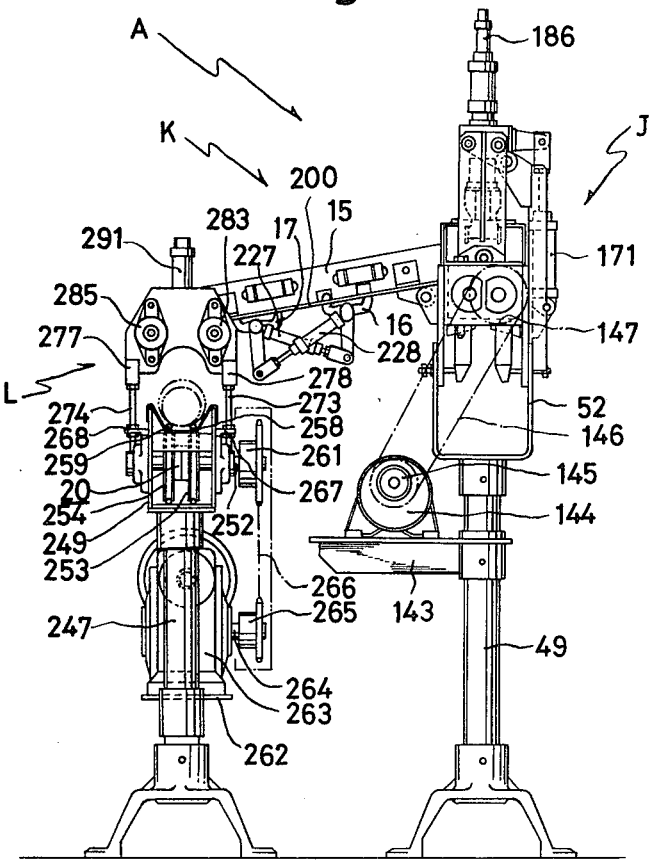
Figure 4:
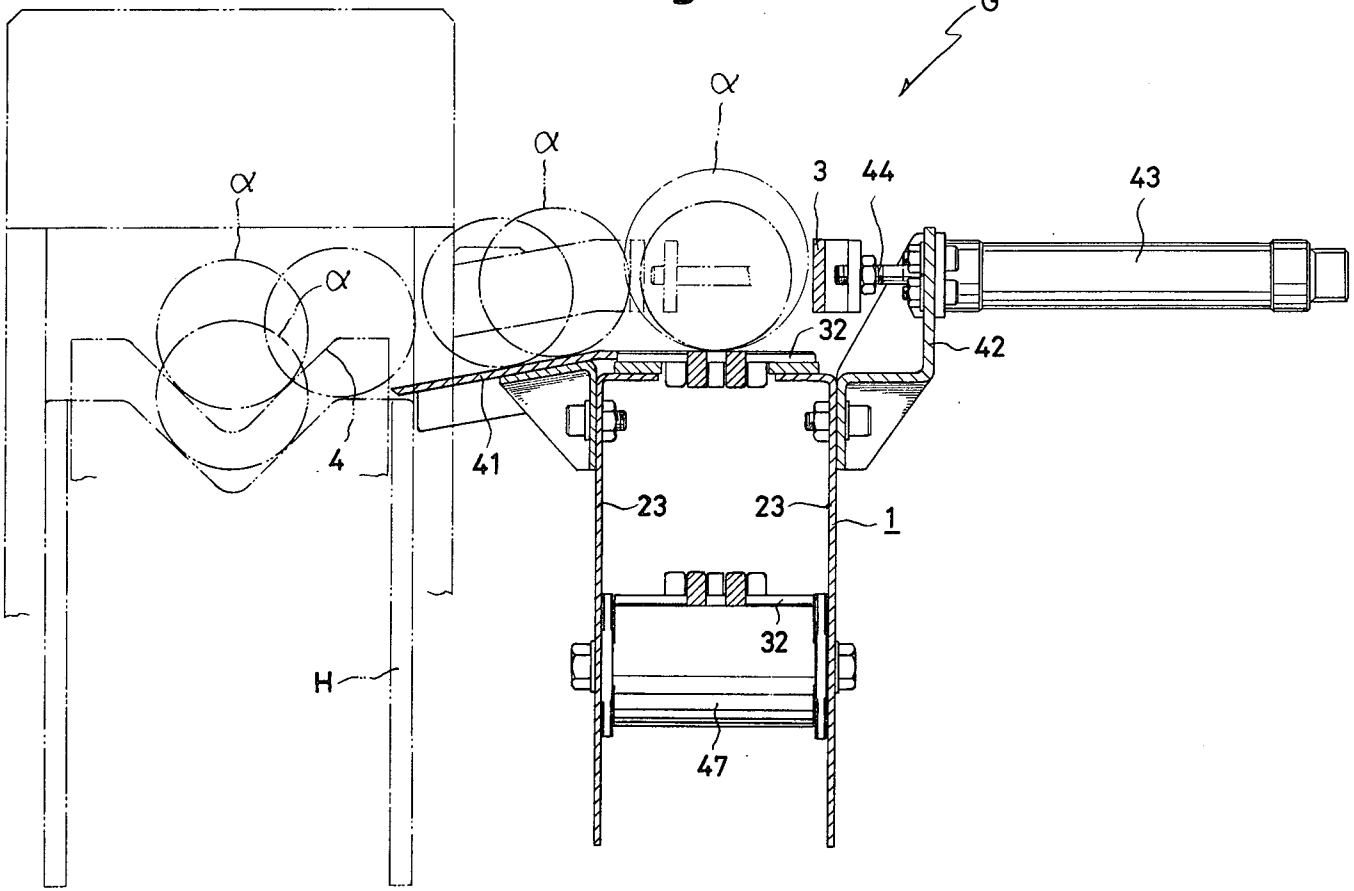
FIG. 4 is an enlarged cross section of an inermittently feeding means shown in FIG. 1 and taken along the line IV—IV in FIG. 1.

In FIG. 2 symbol (M) represents a shredder provided in a collecting box (342) arranged under the peeling means (J), said shredder (M) serving to cut the packaging material ($\beta$) into fine pieces so as to reduce the volume of the packaging materials (β) rolled in between the rolls (12) and (13) and peeled into the collecting box (342) to a volume equal to a hundredth of the original volume of the packaging materials (β).

Figure 21:
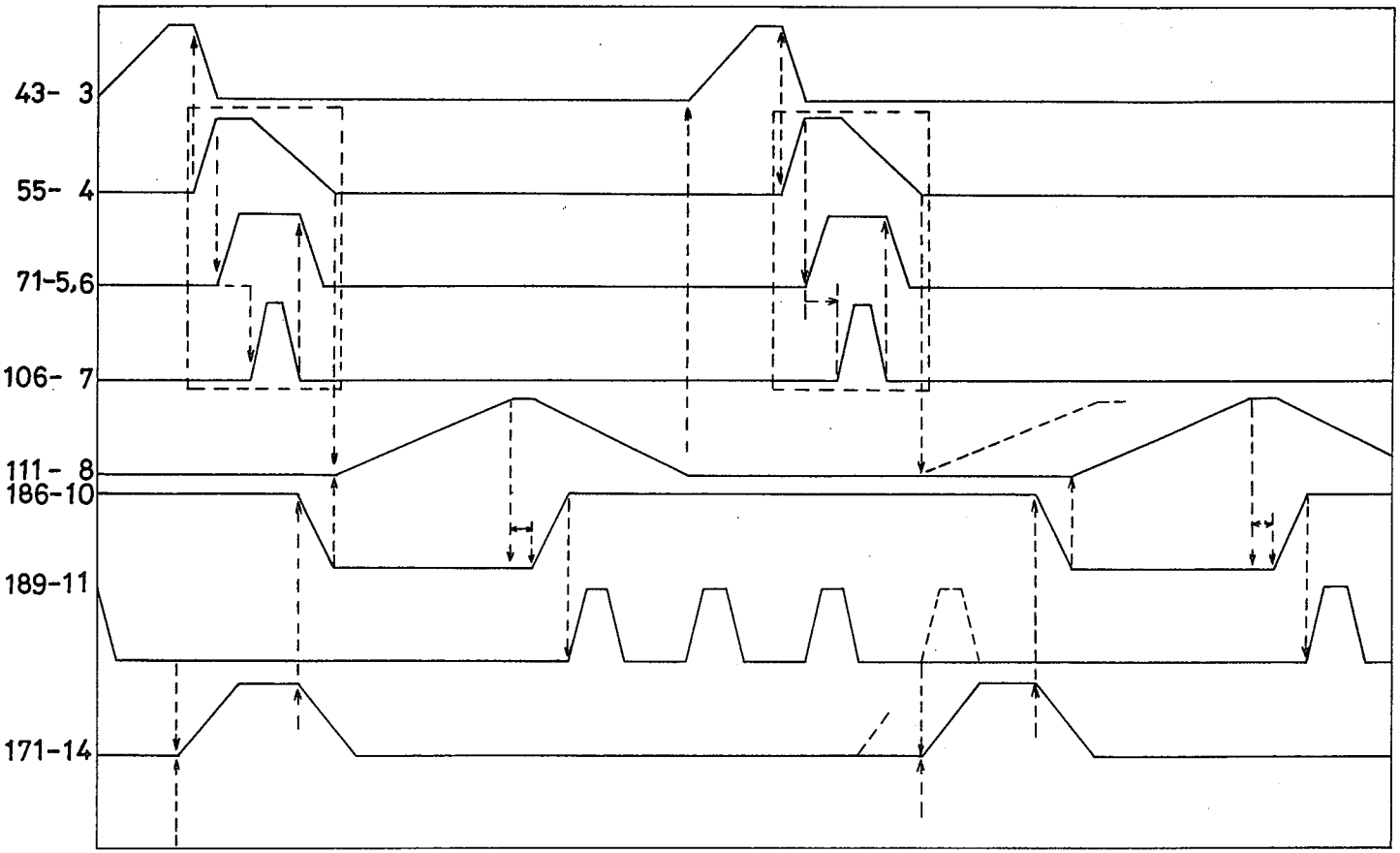
FIG. 21 is a timing chart of the operating portion of each means.

In order to control systematically associated and synchronized operation of the pusher member (3), lifting trough (4), group of grippers (5), (6), cutting member (7), pushing member (8), gate supporter (10), pusher (11) and chamber (14), the present invention provides a sequential control circuit (not shown) which systematically controls the air cylinders (43), (55), (71), (106), (111), (171), (186) and (189) as shown in the timing chart in FIG. 21.

Figure 22:
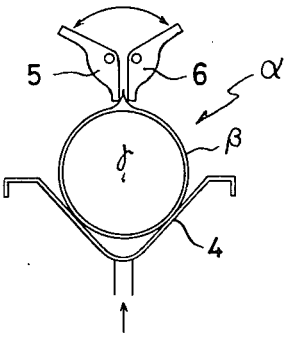
FIGS. 22 through 25 are views showing how the method of the present invention is successively advanced.
Figure 23:
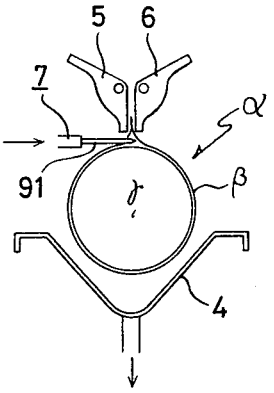
Figure 24:
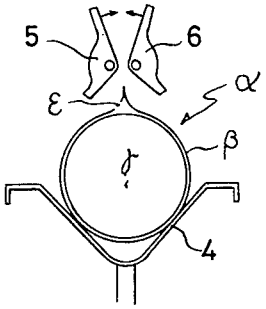
Figure 25:
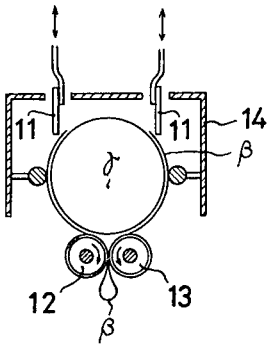

When the foremost end of the package (α) fed by the conveyor (1) of the intermittently feeding means (G) comes to touch the stopper (2), the driving motor (34) is stopped and the conveyor (1) is also stopped. The pushing member driving air cylinder (43) is operated, and the pusher member (3) ready at one side of the conveyor (1) and at the terminal end thereof starts to advance (see (43-3) in FIG. 21). After the package (α) is pushed at the side thereof from the conveyor (1) to the inclined plate (41), the pushing member driving air cylinder (43) is changed over to retreat the pusher member (3) to the original position. At this time the lifting trough driving air cylinder (55) is operated causing the lifting trough, in which the package (α) fed from the inclined plate (41) is now received, to be lifted (see (55-4) in FIG. 21). When the package (α) is brought into contact at the upper portion thereof with the group of grippers (5), (6), which lift the package (α) as shown in FIG. 22, the gripper driving air cylinder (71) is operated to close the group of pairs of grippers (5), (6) (see (71-5,6) in FIG. 21). Immediately after the package (α) is completely gripped at the upper portion and all over the length thereof as shown in FIG. 23, the trough driving air cylinder (55) is changed over to retreat the lifting trough (4) downward to the allowable lowermost position. At the same time the cutter member driving air cylinder (106) is operated to start the swinging movement of the cutter member (7) (see (106-7) in FIG. 21). When a continuous cut line (ε) is formed by means of the group of cutting blades (91) at the gripped upper portion of the packaging material (β) of the product (γ) and all over the length thereof as shown in FIG. 23, and the cutter member (7) is returned to the original position thereof, the gripper driving air cylinder (71) is changed over causing the group of pairs of grippers (5), (6) to be released to the opened original position as shown in FIG. 24. At the same time the gate driving air cylinder (186) is operated to lift the gate supporter (10) causing the receiving opening (14*b*) provided at the back end of the chamber (14), which is now in inclined state, to be opened, while the chamber driving air cylinder (171) is changed over to swing back the inclined chamber (14) to the horizontal original position (see (186-10) and (171-14) in FIG. 21). After then, when the lifting trough (4) comes to the allowable lowermost position thereof and the gate supporter (10) comes to the allowable uppermost position, the pusher member driving air cylinder (111) is operated to start the advancing movement of the pushing member (8) (see (111-8) in FIG. 21). When the package (α), whose packaging material (β) is thrust the continuous cut line (ε) at the upper portion thereof, is slided on the lifting trough (4) to be received through the receiving opening (14*b*) into the chamber (14) now kept horizontal with both sides thereof being guided by the guide rods (168), (169), and fed completely on the pair of rolls (12), (13) now kept static, the pushing member driving air cylinder (111) is changed over to retreat the pushing member (8) to the original position thereof, while the gate driving air cylinder (186) is changed over to lower the gate supporter (10) causing the receiving opening (14*b*) to be closed. When the gate supporter (10) comes to the allowable lowermost position in such a manner that the package (α) now completely received in the chamber is supported at the back end thereof by the gate supporter (10) and at the front end thereof by the supporter (9) resiliently, which is arranged to face the front opening (14*a*) of the chamber (14), the motor (144) is energized to rotate the pair of rolls (12), (13) in opposite direction causing the lower portion of the packaging material (β) to be rolled in between the rolls (12) and (13). On the other hand, the pushing member driving air cylinder (189) is operated to lower the front and back pairs of right and left pusher members (11) (see (189-11) in FIG. 21), which assist the rolling-in and peeling operation of the rolls (12), (13) by pushing downward the front and back upper portions of the packaging material (β) with the continuous cut line (ε) of the package (α) interposed therebetween as shown in FIG. 25. A vacuum source (not shown) is being operated since the start of process to discharge outside the atmosphere in the chamber (14) in which paper dust generated at the time of cutting the packaging material is contained. When the pushing member driving air cylinder (189) is changed over, the pusher members (11) are lifted to finish the first pressing action. When the pushing member driving air cylinder (189) is operated after a certain time period to start the second pressing action of the pusher members (11), the pusher member (3) of the intermittently feeding means (G) starts to supply a second package (α) to the cutting means (H) (see (43-3) in FIG. 21). With a series of associated processes as described above being advanced, the pusher members (11) repeat intermittently the pressing action thereof to finish the third one and the packaging material (β) is completely peeled off to expose the product (γ) contained therein. After predetermined seconds pass since then, the driving motor (144) is deenergized to stop the rotation of the pair of rolls (12), (13). At this time the chamber driving air cylinder (171) is operated to swing the chamber (14) integral with the supporter (9) and gate supporter (10) causing the product (γ) housed in the chamber (14) to be moved as a mass and discharged through the opened underside of the chamber (14) into the accumulator chute (15).

After then, the chamber driving air cylinder (171) is changed over to return the chamber (14) to the horizontal original position thereof, while the gate driving air cylinder is also changed over to lift the gate supporter (10) causing the receiving opening (14*b*) of the chamber (14) to be fully opened. In five or seven seconds at this stage a second package (α) processed through the pusher member (3), lifting trough (4), group of pairs of grippers (5), (6) and cutter member (7) is pushed at the back end thereof by the pushing member (8) to be processed at the timings as described above through the gate supporter (10), the pusher members (11) and the chamber (14).

On the other hand, the product (γ) discharged from the chamber (14) is guided at both ends thereof by the end guide plates (211), (212) and received by the uppermost stopper rod (213) projected above the base plate (200). The change-over of the first seesaw driving air cylinder (227) causes the uppermost stopper rod (213)

to be retreated below the base plate (200) so as to shift stepwise the product (γ) to the stopper rod (214) now projected. Repeating the change-over of the first and second seesaw driving air cylinders (227), (228), the product (γ) is regularly successively shifted from the stopper rod (213) to the one (216) and finally dropped from the terminal end of the accumulator chute (15) onto the pair of closed flappers (18), (19) or (18'), (19') of the discharging means (L) or (L'). When it is detected by an appropriate means that no product (γ) is on the rope conveyor (20) or (20') immediately under the flappers (18), (19) or (18'), (19'), the flapper driving air cylinder(s) (291) or (323), (324) is(are) operated to swing the flappers (18), (19) or (18'), (19') causing the product (γ) to be dropped onto the guiding trough (260) or either (303) or (304), and the product (γ) is then delivered to a seamer (not shown) connected to the rope conveyor (20) or (20').

Though the embodiment of the present invention employs the cutter member (7) as a means for cutting a continuous cut line (ε) into the upper portion of the package (α) and all over the length thereof, it will be understood that the present invention is not limited to the cutter means (7). Namely, there may be employed a cutter means by which a continuous cut line (ε) is formed in such a manner that a knife is thrust into one upper end of the packaging material (β) gripped by a group of pairs of grippers (5), (6) and advanced to the other end of the package (α) leaving the knife thrust into the packaging material (β), or a cutter means by which a continuous cut line (ε) is formed in such a manner that a knife is thrust sideways into one upper end of the gripped packaging material (β) and, after the gripping of the packaging material (β) is released and the knife is fixed leaving the knife thrust into the packaging material, the back end of the package is pushed by the pushing member (8). It will be understood that any of these cutter means is included within the spirit of the present invention.

As described above, the present invention allows the packages to be separated from one another and the cutting and peeling of the packaging material of the package to be processed in a full automatic process line, thus resulting in high reliability and security in operation. In addition, paper dust generated at the time of cutting the packaging material (β) of the package (α) can be sucked and discharged outside at the time of peeling the packaging material, allowing the exposed product (γ) to be cleaned at the same time. Since the delaying and storing means (K) is interposed between the peeling means (J) and the discharging means (L), any accident caused to the means of the apparatus (A) arranged before the peeling means makes it unnecessary to stop the seamer every time when the accident is caused if it can be repaired in a short time, thus enhancing the working efficiency. When the discharging means (L) provided with the rope conveyor (20') is employed, two units of seamers can be connected to the apparatus of the present invention, and even a high speed seamer provided with two can end stackers can be connected to the apparatus of the present invention.

What is claimed is:

1. A method of cutting and peeling the packaging material of elongated packages each containing a product comprising feeding said packages from a feeding section to a cutting section, gripping the packaging material of each package at the upper portion along the length thereof after each said package has been intermittently fed separately one by one from said feeding section to said cutting section, thrusting a plurality of cutting blades of cutter members synchronously and simultaneously into the packaging material to cut a continuous cut line along the whole length between the gripped upper side thereof and the product, feeding the package to a peeling section, forcedly peeling off the packaging material of the package at such peeling section, delivering the peeled and thus exposed product to a delaying section in which the product received from the peeling section is shifted stepwise and successively in dead weight fashion to be delayed and stored therein, feeding said product intermittently from said delaying section to a delivering and discharging section which regularly delivers and discharges in one or more lines the products received intermittently from said delaying section to thereby form a continuous process line.

2. A method according to claim 1 comprising lifting said package upwardly from below for effecting said gripping of said packaging material at the upper portions thereof along its longitudinal length.

3. A method according to claim 1 comprising supporting the package in said peeling section in such a manner that both ends thereof are resiliently supported and that both upper sides of the front and back portions thereof are intermittently pressed.

4. A method according to claim 1 wherein the forced peeling of the packaging material is carried out in a dust collecting atmosphere.

5. Apparatus for cutting and peeling the packaging material of elongated packages each containing a product comprising an intermittently feeding means for intermittently feeding the package separately one by one to a cutting section, a cutting means and a gripping means at said cutting section for lifting the whole package upwardly from below and for simultaneously gripping the package at the upper side along the length thereof while the gripped packaging material of the package is cut simultaneously by a plurality of cutting blades of said cutting means to form a continuous cut line along the whole length between the gripped upper side thereof and the product, means for feeding the package to a peeling section, a peeling and removing means at said peeling section having a pair of rollers, said peeling and removing means resiliently supporting said package at both ends thereof and intermittently pressing the package at both upper sides of the front and back portions thereof with the continuous cut line interposed between said both upper sides while the packaging material of the package is rolled in and peeled between said pair of rollers contacting the underside of the package along its longitudinal axis and the exposed product is then discharged, a delaying and storing means in which the product discharged is shifted stepwise and successively to be delayed and stored therein, said delaying and storing means comprising an accumulator chute for transferring the product regularly in dead weight fashion, said accumulator chute having a base plate, seesaw stoppers alternately projecting through said base plate of the accumulator chute to shift the product stepwise and successively, and a delivering and discharging means in which the products regularly and successively received from the delaying and storing means are discharged in one or more lines to form a continuous process line.

6. Apparatus according to claim 5 wherein said intermittently feeding means comprises a conveyor for conveying the package one at a time, a stopper for positioning and stopping the package conveyed by the conveyor, and a pusher member for pushing the positioned and stopped package to a certain position in the cutting means.

7. Apparatus according to claim 5 wherein said cutting means comprises a lifting trough for receiving one at a time the whole body of the package fed from the intermittently feeding means, said gripping means comprising a group of pairs of grippers for simultaneously gripping the packaging material of the package, which is lifted by the lifting trough, at the upper side and along the length thereof, said plurality of cutting blades simultaneously cutting the packaging material gripped by the group of grippers to form a continuous cut line along the whole length between the gripped upper side thereof and the product, and a pushing means for pushing the package whose packaging material was cut by the cutter means to said peeling and removing means.

8. Apparatus according to claim 5 wherein said peeling and removing means comprises a supporter for resiliently supporting the front end of the package, a gate supporter for closedly supporting the back end of the package, pusher members for intermittently pressing both upper sides of the front and back portions of the package with the continuous cut line of the packaging material interposed between said both upper sides, said pair of rollers contacting the underside of the package along its longitudinal axis to roll in and peel the packaging material therebetween, and a chamber for housing and supporting the package and swinging the product to discharge.

9. Apparatus according to claim 5 wherein said delivering and discharging means comprises a pair of freely swinging flappers for temporarily receiving the product discharged from said delaying and storing means, and a rope conveyor onto which the product is dropped by the swinging action of said flappers and having guiding trough means.

10. Apparatus according to claim 5 wherein said plurality of cutting blades are supported by means which enable the cutting blades to be readily replaced, said cutting blades being arranged at a slant to form a saw-teeth like configuration which is horizontally swung to freely cut a continuous cut line in the packaging material between the gripped upper side of the package and the product.

11. A method of according to claim 2 comprising peeling the entire package material without leaving any portion thereof between both ends of said package and adjacent packages.

* * * * *